US011203214B2

(12) United States Patent
Arakane

(10) Patent No.: US 11,203,214 B2
(45) Date of Patent: Dec. 21, 2021

(54) PRINTING APPARATUS

(71) Applicant: BROTHER KOGYO KABUSHIKI KAISHA, Aichi (JP)

(72) Inventor: Satoru Arakane, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 16/878,733

(22) Filed: May 20, 2020

(65) Prior Publication Data

US 2020/0346471 A1 Nov. 5, 2020

Related U.S. Application Data

(60) Continuation of application No. 16/173,620, filed on Oct. 29, 2018, now Pat. No. 10,661,583, which is a (Continued)

(30) Foreign Application Priority Data

Mar. 31, 2016 (JP) ..... 2016-073387

(51) Int. Cl.
*B41J 29/38* (2006.01)
*B41J 13/00* (2006.01)
*B41J 11/00* (2006.01)

(52) U.S. Cl.
CPC ..... *B41J 13/0009* (2013.01); *B41J 11/008* (2013.01)

(58) Field of Classification Search
CPC ..... B41J 11/008; B41J 13/0009
See application file for complete search history.

(56) References Cited

U.S. PATENT DOCUMENTS 7,641,330 B2 1/2010 Ozaki et al.
7,971,952 B2 7/2011 Furuhata
(Continued)

FOREIGN PATENT DOCUMENTS

JP H01-253471 A 10/1989
JP H07-047740 A 2/1995
(Continued)

OTHER PUBLICATIONS

Notice of Allowance dated Jun. 26, 2018 received in parent U.S. Appl. No. 15/472,571.
(Continued)

*Primary Examiner* — Lam S Nguyen
(74) *Attorney, Agent, or Firm* — Scully, Scott, Murphy & Presser, PC

(57) ABSTRACT

A printing apparatus, including a conveyor, a liquid ejection head with nozzles, a contact part to contact a surface of a recording medium and a controller, is provided. The controller executes printing processes including a first printing process with a first conveying action and a second printing process with a second conveying action. The controller obtains a length of a non-printing region in the recording medium, and in the second printing process, designates a nozzle within a contact range, in which the recording medium is maintained contacted by the contact part upon completion of the conveying action in a final printing process, to be a second nozzle, which is activated to print a most downstream part of the image. The longer the length of the non-printing region is, the closer nozzle closer to an upstream end of conveyance among the plurality of nozzles is designated to be the second nozzle.

8 Claims, 11 Drawing Sheets

Related U.S. Application Data division of application No. 15/472,571, filed on Mar. 29, 2017, now Pat. No. 10,112,419.

(56) References Cited

U.S. PATENT DOCUMENTS

| | | | | |
|---|---|---|---|---|
| 2002/0044165 | A1 | 4/2002 | Otsuki | |
| 2002/0070991 | A1 | 6/2002 | Otsuki | |
| 2008/0198195 | A1 | 8/2008 | Matsumura | |
| 2010/0033525 | A1 | 2/2010 | Kunihiro | |
| 2010/0045726 | A1 | 2/2010 | Nakajima | |
| 2012/0223987 | A1 | 9/2012 | Arakane | |
| 2014/0168300 | A1* | 6/2014 | Kubo | B41J 11/008 347/11 |
| 2014/0292867 | A1 | 10/2014 | Takata | |
| 2015/0029254 | A1 | 1/2015 | Arakane | |
| 2015/0035891 | A1 | 2/2015 | Koshida et al. | |

FOREIGN PATENT DOCUMENTS

| | | | |
|---|---|---|---|
| JP | 2002-103584 | A | 4/2002 |
| JP | 2007-125769 | A | 5/2007 |
| JP | 2014-193531 | A | 10/2014 |
| JP | 2015-030149 | A | 2/2015 |

OTHER PUBLICATIONS

Office Action dated Sep. 16, 2019 received in parent U.S. Appl. No. 16/173,620.

Notice of Allowance dated Jan. 22, 2020 received in parent U.S. Appl. No. 16/173,620.

Japanese Office Action dated Dec. 24, 2019 received from the Japanese Patent Office in application JP 2016-073387, together with an English language translation.

* cited by examiner

PRINTING APPARATUS

CROSS REFERENCE TO RELATED APPLICATION

This application is a continuation application of U.S. Ser. No. 16/173,620 filed on Oct. 29, 2018, which is a divisional application of U.S. Ser. No. 15/472,571 filed on Mar. 29, 2017, now U.S. Pat. No. 10,112,419 granted Oct. 30, 2018 and claims priority under 35 U.S.C. § 119 from Japanese Patent Application No. 2016-073387, filed on Mar. 31, 2016, the entire subject matter of each of which is incorporated herein by reference.

BACKGROUND

Technical Field

The following description relates to one or more aspects of a printing apparatus capable of ejecting liquid through nozzles to print an image.

Related Art

A printing apparatus, or a printer, configured to eject liquid through nozzles at a recording sheet to print an image, is known. The printer may print the image on the recording sheet by conducting an ejecting action, in which ink is ejected from an inkjet head through nozzles at the recording sheet placed on a platen, and a conveying action, in which the recording sheet is conveyed by a conveyor in a conveying direction, alternately. The conveyor may include conveyance rollers, which are arranged at positions upstream and downstream from the inkjet head along the conveying direction.

SUMMARY

The printer may repeat the ejecting action and the conveying action alternately for a plurality of times to complete the image. As the actions proceed, in the ejecting action conducted later, e.g., in a final one of the ejecting actions to print a most upstream part of the image with regard to the conveying direction, an upstream end of the recording sheet may be located at a position downstream apart from the upstream one of the conveyance rollers. In this position, the recording sheet may not be held or pressed by the upstream one of the conveyance rollers. If the recording sheet is not pressed by the upstream one of the conveyance rollers while the upstream part of the image is being printed, the upstream end of the recording sheet may hover upward and touch an ink-ejection surface of the inkjet head, where the nozzles are formed. If the recording sheet touches the ink-ejection surface, the ink may be transferred from the nozzles to the recording sheet to create an undesired ink spot.

An aspect of the present disclosure is advantageous in that a printing apparatus, in which an upstream end of a recording medium with regard to a conveying direction is prevented from hovering while an upstream part of an image is being printed on the recording medium, is provided.

According to an aspect of the present disclosure, a printing apparatus including a conveyor, a liquid ejection head, a contact part, and a controller is provided. The conveyor is configured to convey a recording medium in a conveying direction. The liquid ejection head includes a plurality of nozzles, which are arranged along the conveying direction to form a nozzle array. The contact part is configured to contact a surface of the recording medium that faces the liquid ejection head at a position upstream with regard to the conveying direction from a nozzle located at a most upstream position among the plurality of nozzles that form the nozzle array. The controller configured to control the conveyor and the liquid ejection head. The controller executes a plurality of printing processes. Each one of the plurality of printing processes includes a conveying action, in which the controller controls the conveyor to convey the recording sheet in the conveying direction, and an ejecting action, in which after the conveying action the controller controls the liquid ejection head to eject liquid from the plurality of nozzles toward the recording medium to print an image. The conveying action includes a first conveying action and a second conveying action. In the first conveying action, a first nozzle among the plurality of nozzles that form the nozzle array is designated to be a nozzle active at a most downstream position with regard to the conveying direction for the ejecting action. The first nozzle is located at a position downstream from the nozzle at the most upstream position with regard to the conveying direction. In the first conveying action, the controller controls the conveyor to convey the recording medium for a first conveyance amount based on print data. In the second conveying action, a second nozzle among the plurality of nozzles that form the nozzle array is designated to be a nozzle active to print a most downstream part of the image that is to be printed in the ejecting action. The second nozzle is located at a position upstream from the first nozzle with regard to the conveying direction. In the second conveying action, the controller controls the conveyor to convey the recording medium for a second conveyance amount being smaller than the first conveyance amount for a nozzle shift amount. The nozzle shift amount is equal to a length between the first nozzle and the second nozzle along the conveying direction. The plurality of printing processes include at least one occurrence of a first printing process and at least one occurrence of a second printing process. The first printing process takes the first conveying action as the conveying actions, and the second printing process takes the second conveying action as the conveying action. The controller further executes a length information obtaining process, in which length information related to a length of a non-printing region in the recording medium is obtained. The non-printing region is a region in which no image is printed and is reserved at a rim of an upstream side of the recording medium with regard to the conveying direction. In the second printing process, the controller designates the second nozzle, within a contact range in which the recording medium is maintained contacted by the contact part at a point where the conveying action in a final one of the plurality of printing processes is completed, such that the longer the length of the non-printing region indicated in the obtained length information is, the closer nozzle closer to an upstream end of conveyance among the plurality of nozzles that form the nozzle array is designated to be the second nozzle.

According to another aspect of the present disclosure, a printing apparatus including a conveyor, a liquid ejection head, and a controller is provided. The conveyor includes a conveyance roller configured to convey a recording medium in a conveying direction. The liquid ejection head includes a plurality of nozzles, which are arranged along the conveying direction to form a nozzle array. A nozzle among the plurality of nozzles that form the nozzle array at a most upstream position with regard to the conveying direction is located at a position downstream from the conveyance roller with regard to the conveying direction. The controller is configured to control the conveyor and the liquid ejection head. The controller executes a plurality of printing processes. Each one of the plurality of printing processes includes a conveying action, in which the controller controls the conveyor to convey the recording sheet in the conveying direction, and an ejecting action, in which after the conveying action the controller controls the liquid ejection head to eject liquid from the plurality of nozzles toward the recording medium to print an image. The conveying action includes a first conveying action and a second conveying action. In the first conveying action, a first nozzle among the plurality of nozzles that form the nozzle array is designated to be a nozzle active at a most downstream position with regard to the conveying direction for the ejecting action. The first nozzle is located at a position downstream from the nozzle at the most upstream position with regard to the conveying direction. In the first conveying action, the controller controls the conveyor to convey the recording medium for a first conveyance amount based on print data. In the second conveying action, a second nozzle among the plurality of nozzles that form the nozzle array is designated to be a nozzle active to print a most downstream part of the image that is to be printed in the ejecting action. The second nozzle is located at a position upstream from the first nozzle with regard to the conveying direction. In the second conveying action, the controller controls the conveyor to convey the recording medium for a second conveyance amount, which is smaller than the first conveyance amount for a nozzle shift amount. The nozzle shift amount is equal to a length between the first nozzle and the second nozzle along the conveying direction. The plurality of printing processes include at least one occurrence of a first printing process and at least one occurrence of a second printing process. The first printing process takes the first conveying action as the conveying actions, and the second printing process takes the second conveying action as the conveying action. The controller further executes a length information obtaining process, in which length information related to a length of a non-printing region in the recording medium is obtained. The non-printing region is a region in which no image is printed and is reserved at a rim of an upstream side of the recording medium with regard to the conveying direction. In the second printing process, the controller designates the second nozzle, within a contact range in which the recording medium is maintained contacted by the conveyance roller at a point where the conveying action in a final one of the plurality of printing processes is completed, such that the longer the length of the non-printing region indicated in the obtained length information is, the closer nozzle closer to an upstream end of conveyance among the plurality of nozzles that form the nozzle array is designated to be the second nozzle.

According to still another aspect of the present disclosure, a printing apparatus including a conveyor, a liquid ejection head, a contact part, and a controller is provided. The conveyor is configured to convey a recording medium in a conveying direction. The liquid ejection head includes a plurality of nozzles, which are arranged along the conveying direction to form a nozzle array. The contact part is configured to contact a surface of the recording medium that faces the liquid ejection head at a position upstream with regard to the conveying direction from a nozzle located at a most upstream position among the plurality of nozzles that form the nozzle array. The controller is configured to control the conveyor and the liquid ejection head. The controller controls the conveyor and the liquid ejection head to print an image on the recording medium in a margined print mode, in which a margin is reserved in a part of a rim of an upstream side of the recording medium with regard to the conveying direction. The margin has a length along the conveying direction being equal to or larger than a predetermined minimum margin length. The contact part is arranged at a position spaced apart from the nozzle at the most upstream position with regard to the conveying direction among the plurality of nozzles that form the nozzle array for a distance shorter than the minimum margin length.

BRIEF DESCRIPTION OF THE ACCOMPANYING DRAWINGS

Figure 8A:
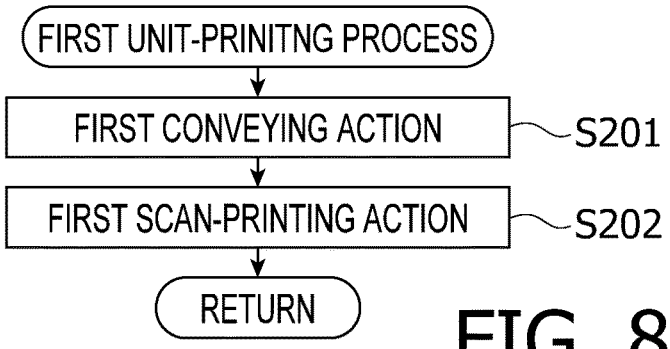
Figure 8B:
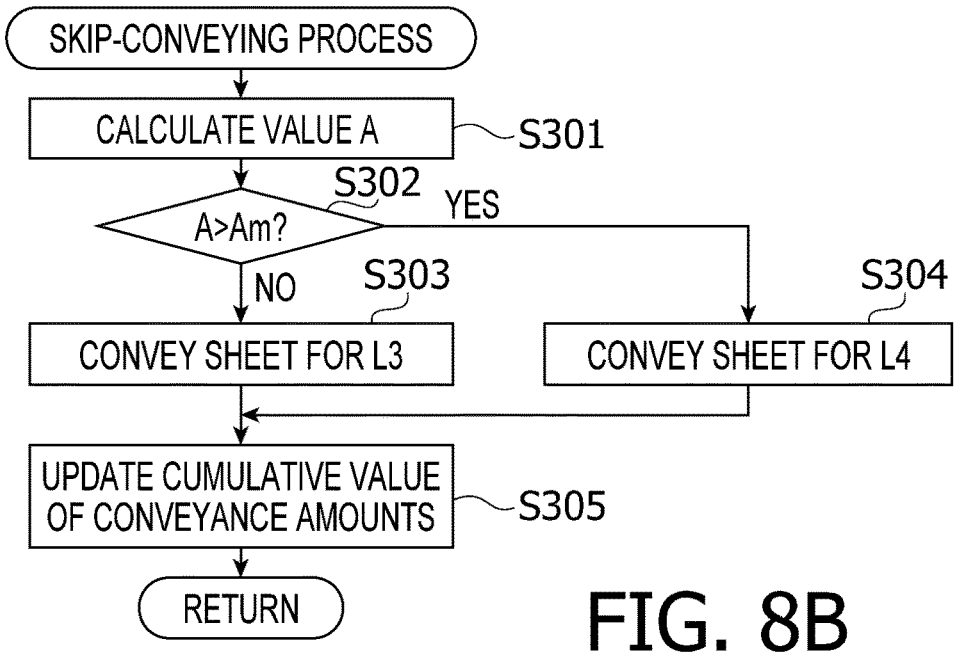
Figure 8C:
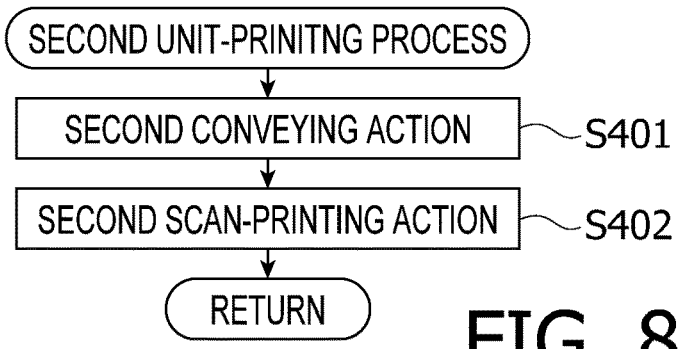

FIG. 8A is a flowchart to illustrate a flow of steps in a first unit-printing process to be conducted by the controller in the printer according to the first embodiment of the present disclosure. FIG. 8B is a flowchart to illustrate a flow of steps in a skip-conveying action to be conducted by the controller in the printer according to the first embodiment of the present disclosure. FIG. 8C is a flowchart to illustrate a flow of steps in a second unit-printing process to be conducted by the controller in the printer according to the first embodiment of the present disclosure.

Figure 9A:
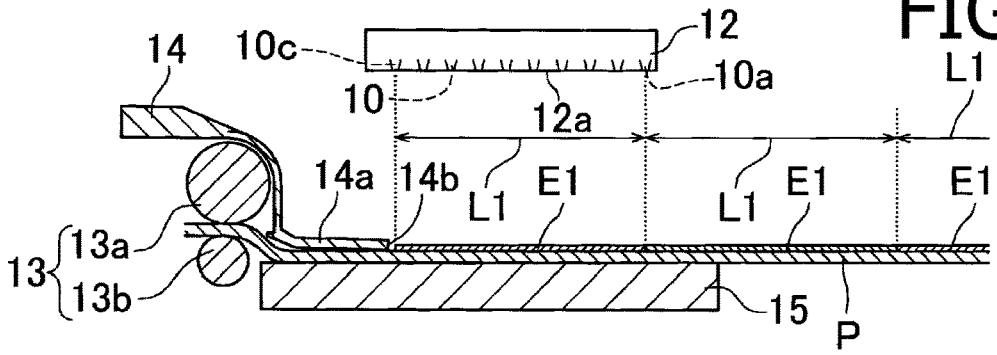
Figure 9B:
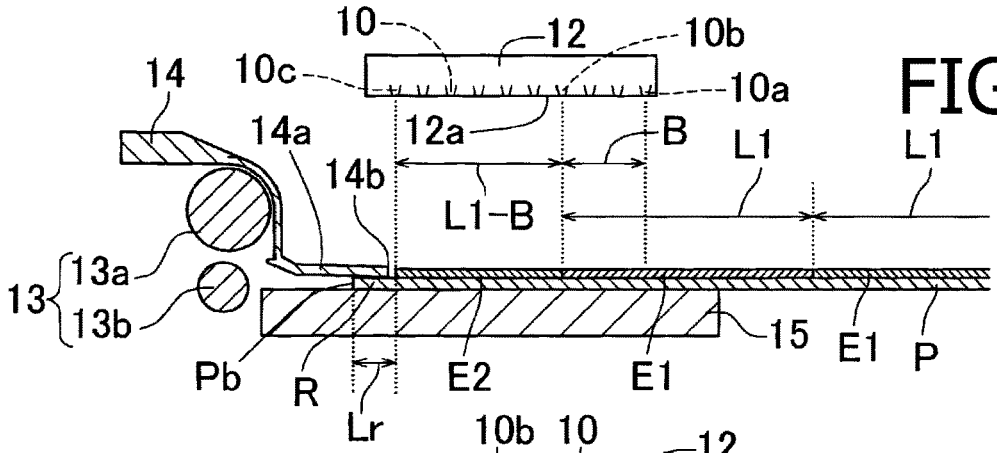
Figure 9C:
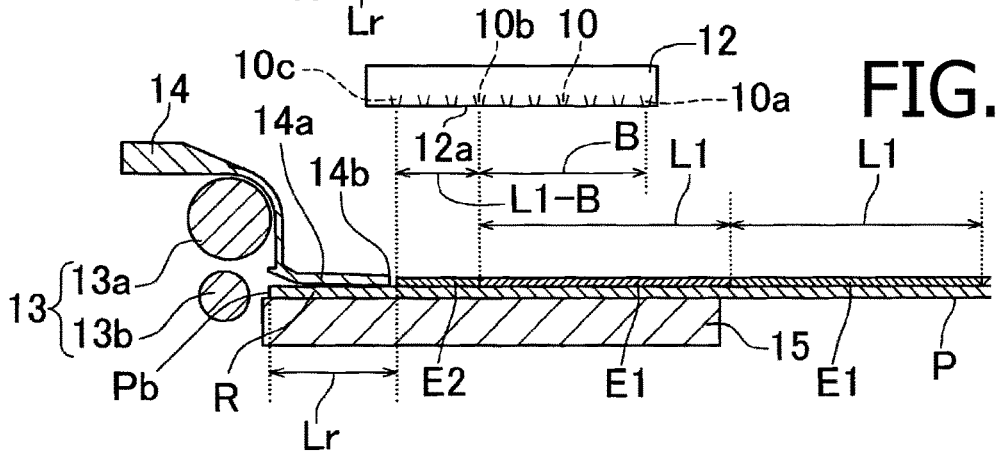
Figure 9D:
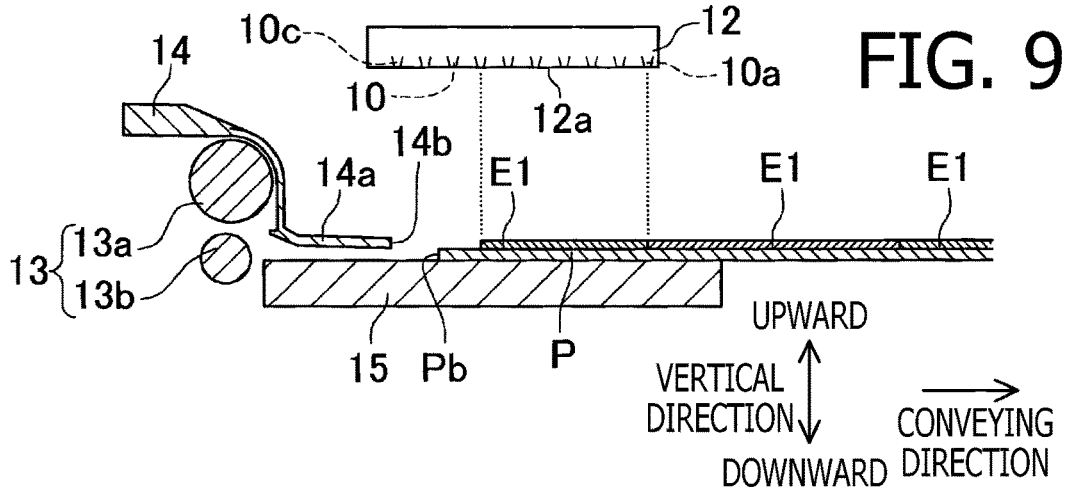

FIG. 9A illustrates relative positions of an inkjet head, corrugating plates, and a recording sheet in the printer during the first unit-printing process according to the first embodiment of the present disclosure. FIG. 9B illustrates relative positions of the inkjet head, the corrugating plates, and the recording sheet in the printer during the second unit-printing process according to the first embodiment of the present disclosure. FIG. 9C illustrates relative positions of the inkjet head, the corrugating plates, and the recording sheet in the printer during the second unit-printing process, when a nozzle shift amount takes a relatively large value, according to the first embodiment of the present disclosure. FIG. 9D illustrates relative positions of the inkjet head, the corrugating plates, and the recording sheet in the printer, when the recording sheet is separated from the pressers, according to the first embodiment of the present disclosure.

Figure 10:
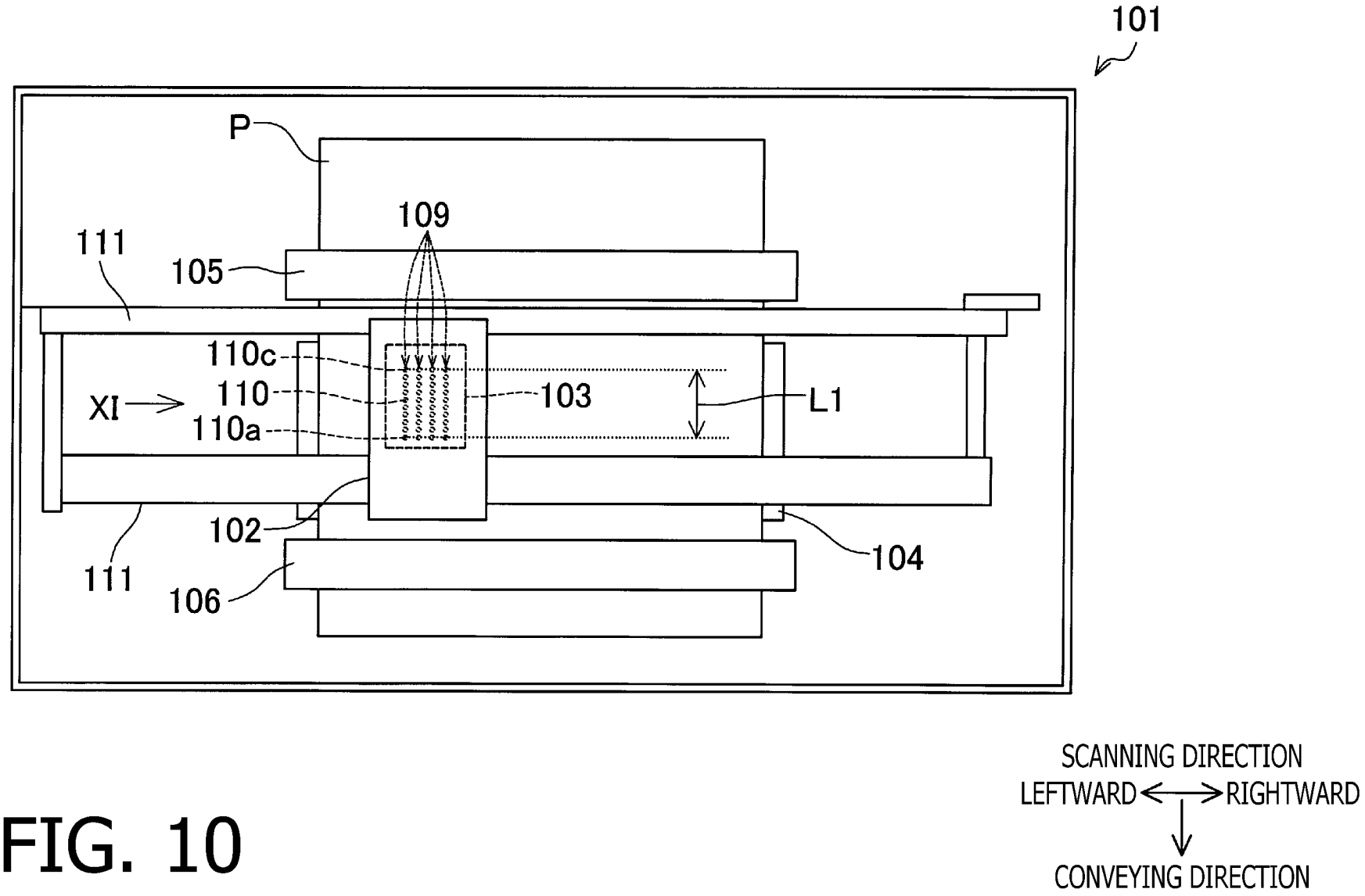

FIG. 10 is a plan view of the printing unit in the printer according to a second embodiment of the present disclosure.

Figure 11:
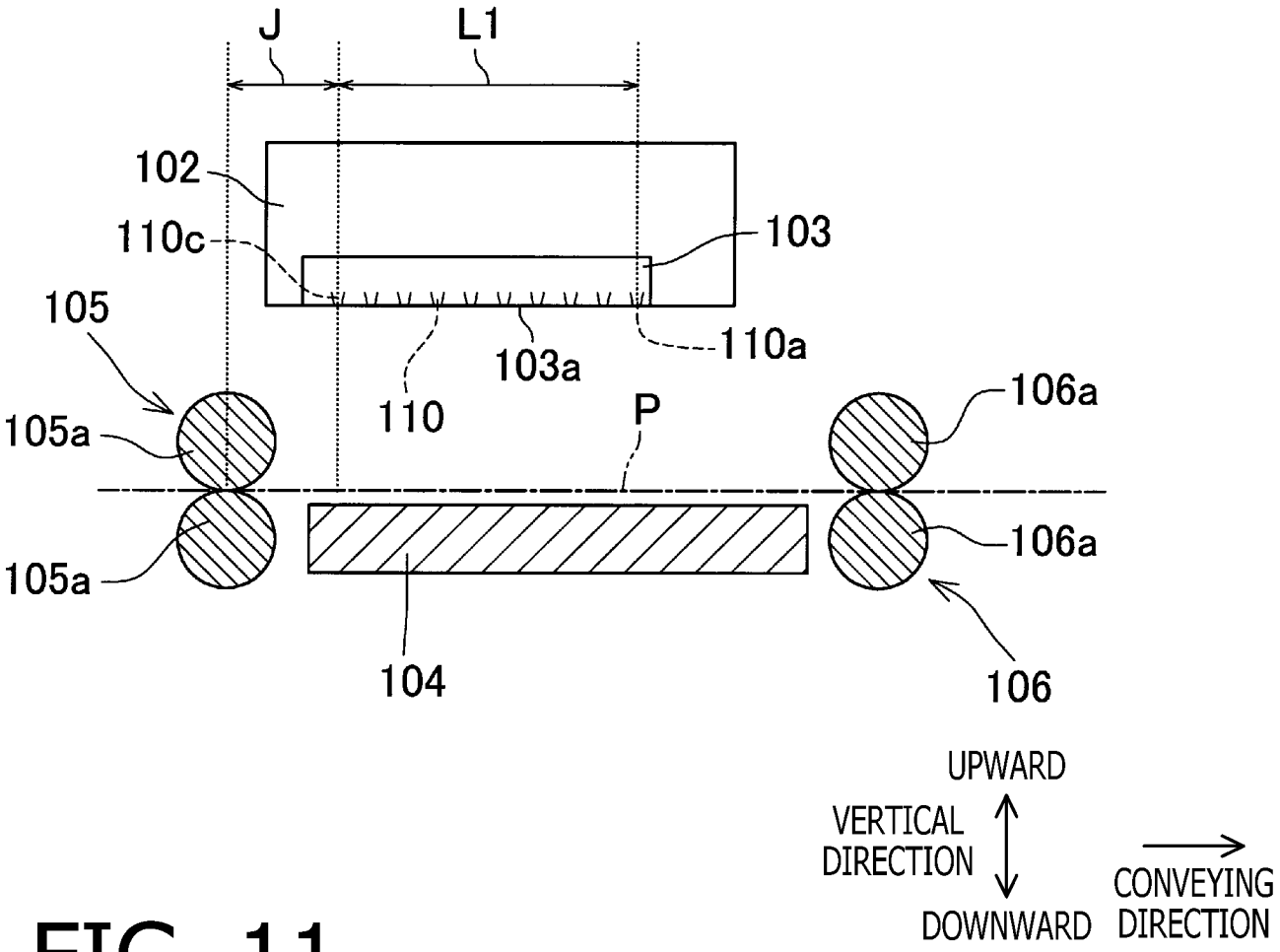

FIG. 11 illustrates relative positions of a carriage, a platen, and conveyance rollers in the printer viewed along an arrow XI shown in FIG. 10 according to the second embodiment of the present disclosure.

Figure 12:
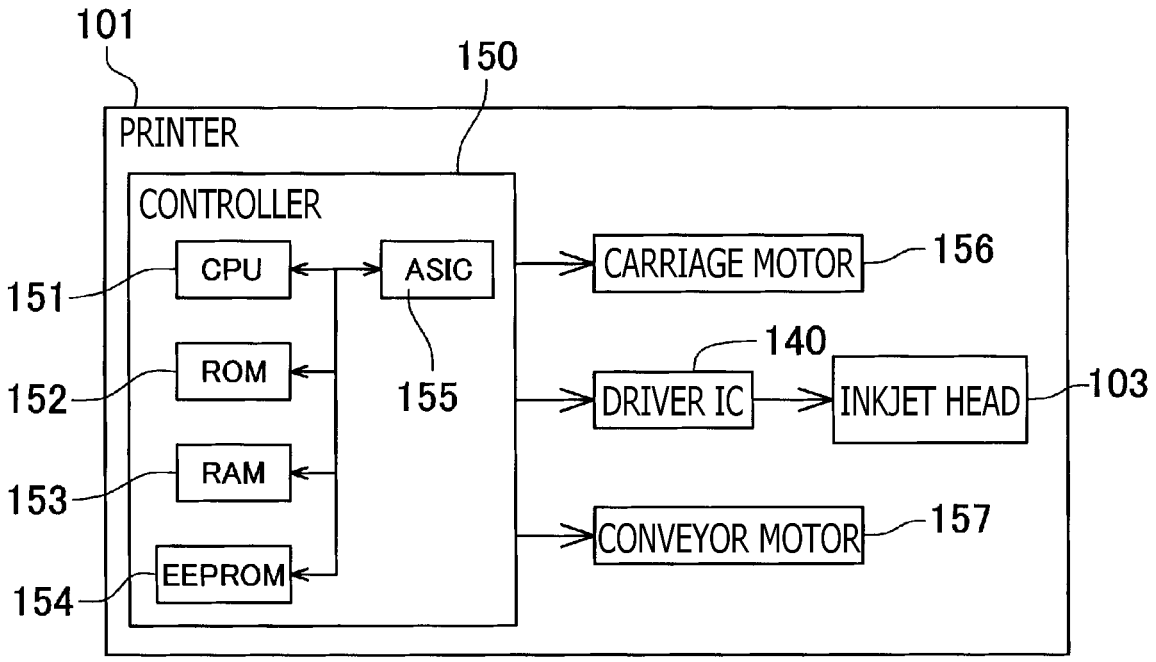

FIG. 12 is a block diagram to illustrate an electrical configuration of the printer according to the second embodiment of the present disclosure.

DETAILED DESCRIPTION

Hereinafter, embodiments according to an aspect of the present disclosure will be described in detail with reference to the accompanying drawings.

It is noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an electrically erasable ROM (EEPROM), a CD-media, DVD-media, temporary storage, hard disk drives, floppy drives, permanent storage, and the like.

First Embodiment

[Overall Configuration of the Printer]

A printer 1 of a first embodiment may be a multi-function peripheral (MFP) having a plurality of functions such as a printing function to print an image on a recording sheet P and an image reading function to read an image on a sheet. The printer 1 includes a printing unit 2 (see FIG. 2), a sheet feeder unit 3, a sheet ejector unit 4, a reader unit 5, an operation unit 6, and a display unit 7. Further, the printer 1 includes a controller 50 configured to control operations and processes in the printer 1 (see FIG. 5).

The printing unit 2 is disposed inside the printer 1. The printing unit 2 is configured to perform printing with the recording sheet P. A detailed configuration of the printing unit 2 will be described later. The sheet feeder unit 3 is configured to feed the recording sheet P to the printing unit 2. The feeder unit 3 may contain different sizes of recording sheets P separately, and one of the different-sized recording sheets P may be selectively fed to the printing unit 2 during a printing operation. The sheet ejector unit 4 is configured to eject the recording sheet P, on which an image is printed by the printing unit 2, outside. The reader unit 5 may be an image scanner and may be configured to read images formed on original sheets. The operation unit 6 may include buttons. A user may operate the printer 1 via the buttons in the operation unit 6 to enter information or instructions. The display unit 7 may be a liquid crystal display, which may display information when the printer 1 is being used.

[Printing Unit]

Figure 2:
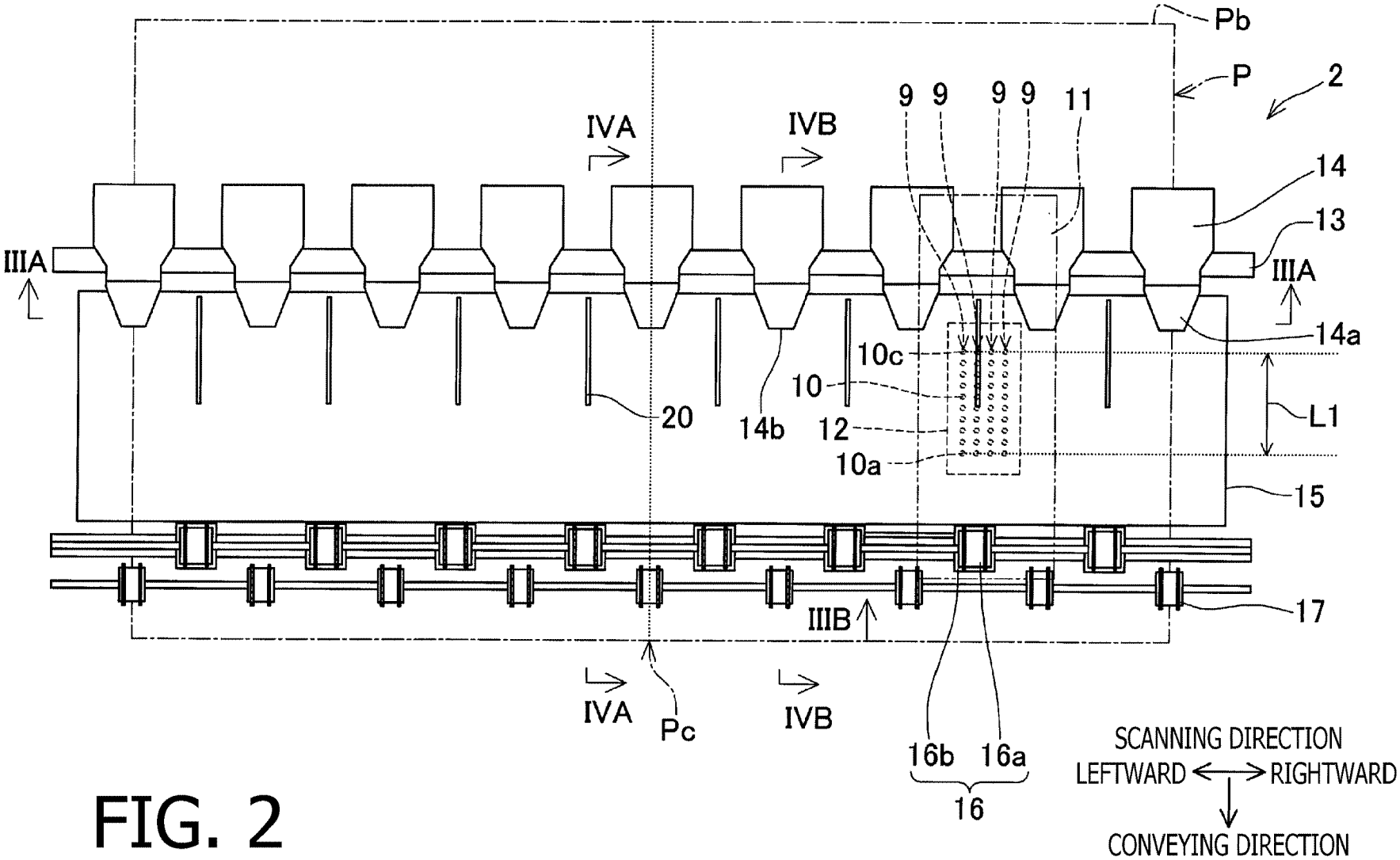
FIG. 2 is a plan view of a printing unit in the printer according to the first embodiment of the present disclosure.
Figure 3A:
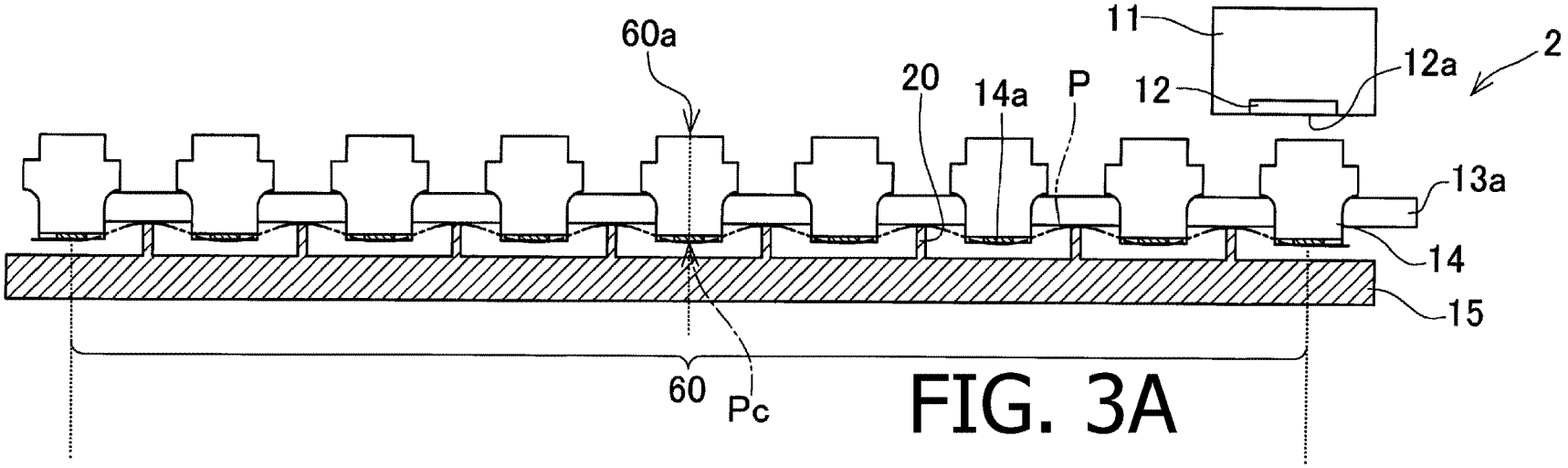
FIG. 3A illustrates a part of the printing unit viewed along an arrow IIIA shown in FIG. 2 according to the first embodiment of the present disclosure.
Figure 3B:
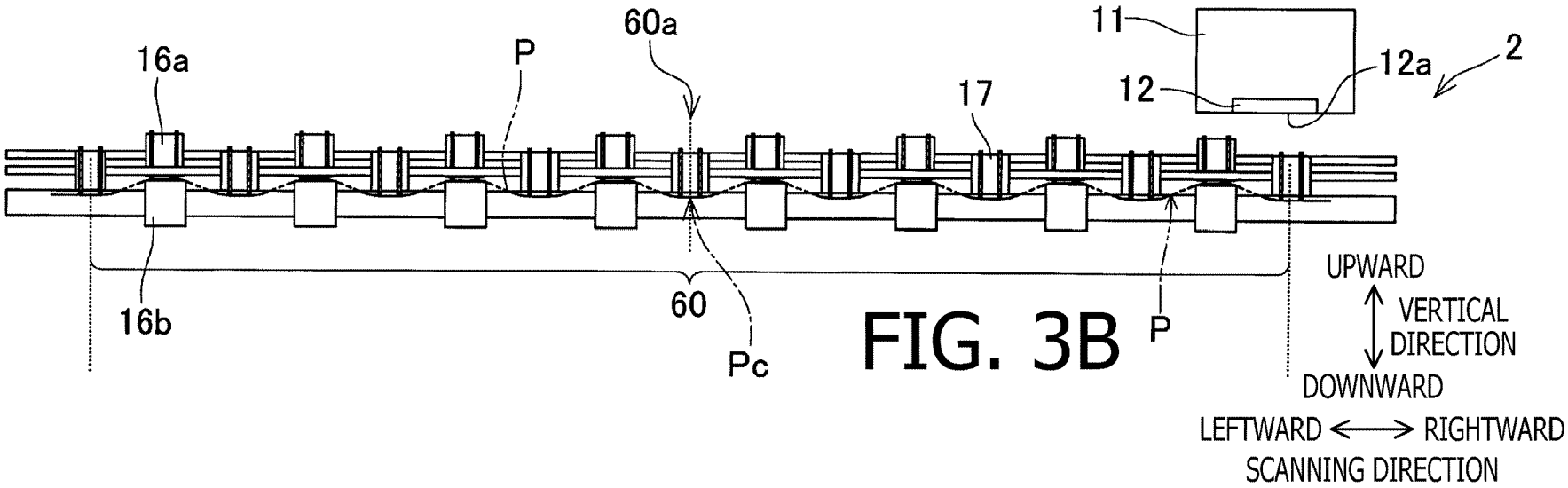
FIG. 3B illustrates a part of the printing unit viewed along an arrow IIIB shown in FIG. 2 according to the first embodiment of the present disclosure.
Figure 4A:
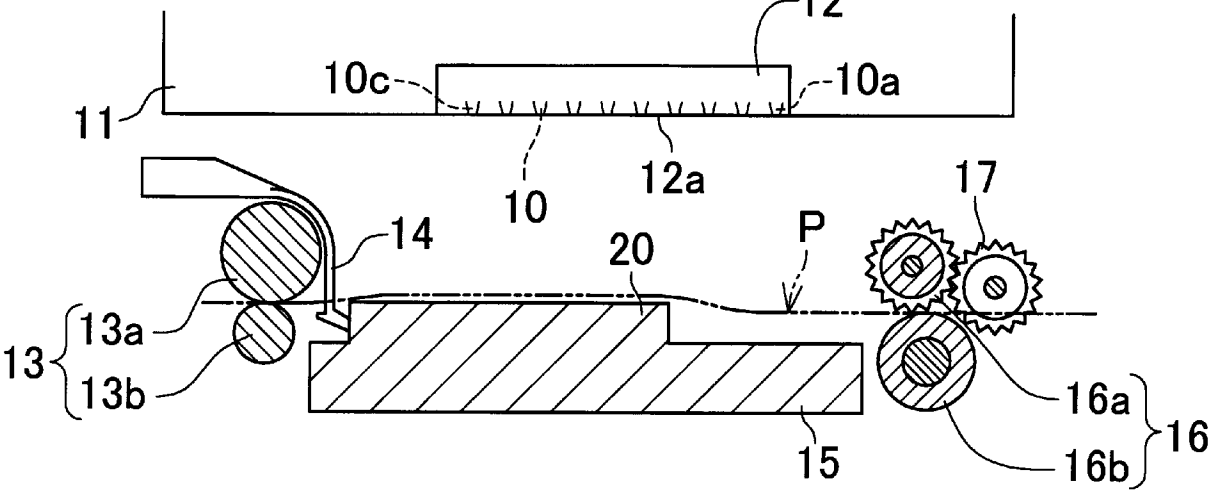
FIG. 4A is a cross-sectional view taken along a line IVA-IVA shown in FIG. 2 according to the first embodiment of the present disclosure.
Figure 4B:
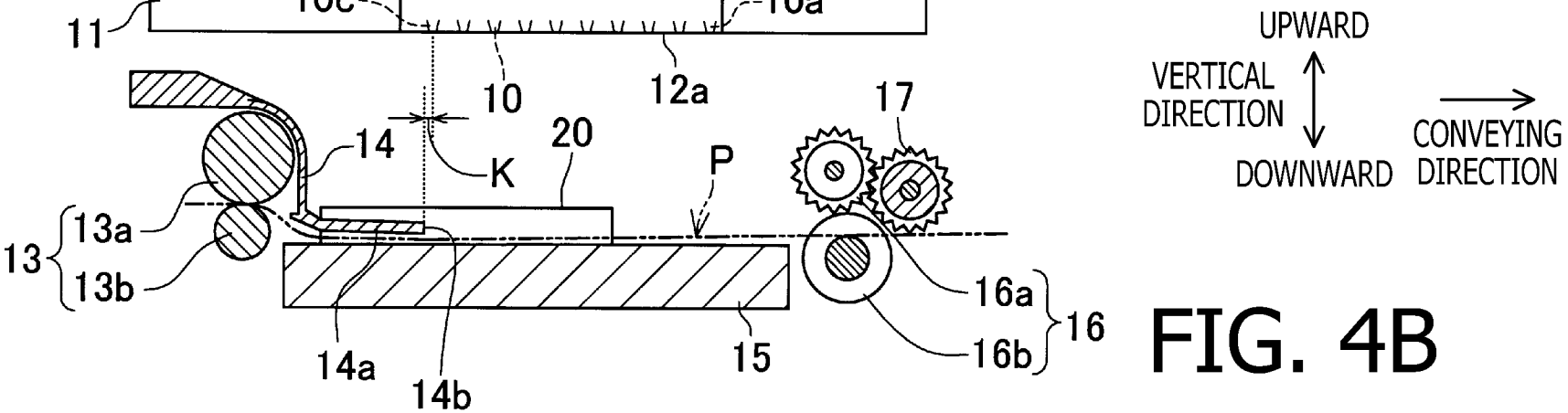
FIG. 4B is a cross-sectional view taken along a line IVB-IVB shown in FIG. 2 according to the first embodiment of the present disclosure.

Below will be described the printing unit 2. As shown in FIGS. 2 to 4, the printing unit 2 includes a carriage 11, an inkjet head 12, a conveyance roller 13, a platen 15, a plurality of (e.g., nine) corrugating plates 14, a plurality of (e.g., eight) ejection rollers 16, and a plurality of (e.g., nine) corrugating spur wheels 17. It is noted that, for the purpose of easy visual understanding in FIG. 2, the carriage 11 in an illustrative position is indicated by a dash-and-two-dots line, and items disposed below the carriage 11 are indicated by solid lines. Further, in FIG. 2, illustration of some of structures that support the carriage 11, e.g., a guiderail, may be omitted.

Figure 1:
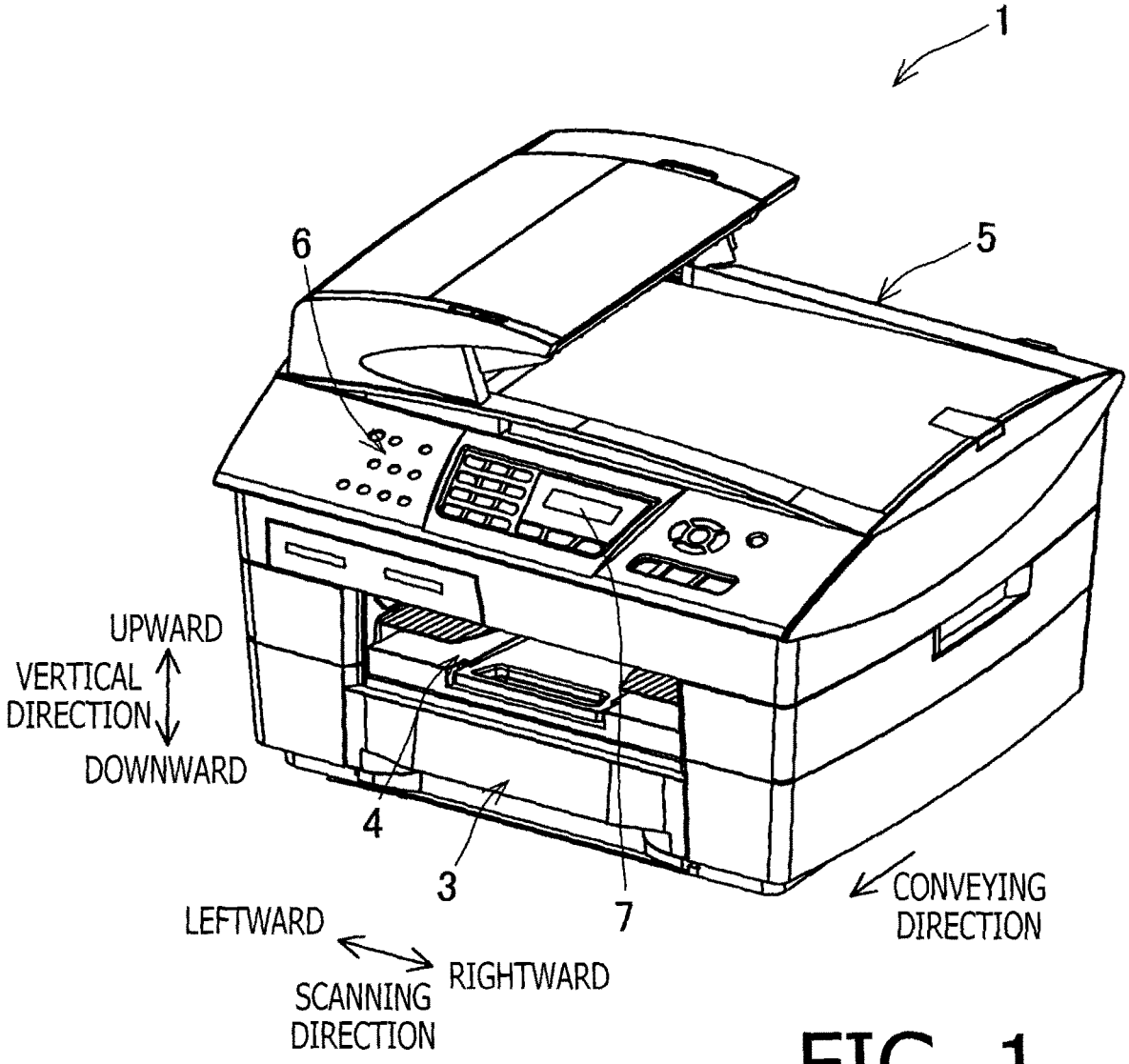
FIG. 1 is a perspective view schematically showing a configuration of a printer according to a first exemplary embodiment of the present disclosure.

The carriage 11 is configured to reciprocate on the guiderail (not shown) along a scanning direction. In the present embodiment, the scanning direction may include a leftward (right-to-left) direction and a rightward (left-to-right) direction (see FIGS. 1 and 2, for example) and may be referred to as a widthwise direction. The carriage 11 is connected with a carriage motor 56 (see FIG. 5) through a belt (not shown) to be moved to reciprocate in the scanning direction. In the following description, one end on the left and the other end on the right along the scanning direction will be defined as a leftward end and a rightward end, respectively.

The inkjet head 12 is mounted on the carriage 11 to be movable along with the carriage 11. The inkjet head 12 is configured to eject ink from a plurality of nozzles 10 formed in an ink ejection surface 12*a*, which is a lower surface of the inkjet head 12. The nozzles 10 are formed in lines that extend orthogonally to the scanning direction within a length L1 to form nozzle arrays 9. In the inkjet head 12, a plurality of, e.g., four, nozzle arrays 9 are formed so that inks in four colors, e.g., black, yellow, cyan, and magenta, may be ejected separately from each nozzle array 9. For example, the nozzles 10 in the rightmost nozzle array 9 may eject black ink, and the nozzles 10 in the nozzle arrays 9 from the second, third, and fourth to the right may eject other colored (e.g., yellow, cyan, and magenta) inks, respectively. The inkjet head 12 may be driven by a driver IC 40 (see FIG. 5).

The conveyance roller 13 is arranged in a position upstream of the inkjet head 12 with regard to a predetermined conveying direction, which may intersect orthogonally with the scanning direction, to convey the recording sheet P. The conveyance roller 13 includes an upper roller 13*a* and a lower roller 13*b*, which are configured to nip therebetween the recording sheet P fed by the sheet feeder unit 3 and convey the recording sheet P in the conveying direction. The upper roller 13*a* may be driven to rotate by a conveyor motor 57 (see FIG. 5), and the lower roller 13*b* may be rotated along with rotation of the upper roller 13*a*.

The nine (9) corrugating plates 14 are disposed to extend from a position coincident with the conveyance roller 13 to a position downstream of the conveyance roller 13 with regard to the conveying direction. The corrugating plates 14 are arranged to be spaced apart evenly from one another at an interval along the scanning direction. Each of the corrugating plates 14 includes a presser 14*a*, which may contact to press the recording sheet P downward, at a downstream end 14*b* thereof with regard to the conveying direction. The downstream end 14*b* of each presser 14*a* is located at a position downstream from an upstream end of the inkjet head 12 and upstream from a position of nozzles 10*c* that are located most upstream among the plurality of nozzles 10 in the nozzle arrays 9. A distance K between the downstream ends 14*b* of the pressers 14*a* and the nozzle 10*c* with regard to the conveying direction may be, for example, 2 mm.

The platen 15 is arranged in a position downstream of the conveyance roller 13 with regard to the conveying direction to vertically face the ink ejection surface 12*a* of the inkjet head 12. The platen 15 is arranged to longitudinally extend in the scanning direction to cover an entire movable range of the carriage 11 that may move to reciprocate during a printing operation. On an upper surface of the platen 15, formed are a plurality of (e.g., eight) ribs 20, which extend in the conveying direction. The ribs 20 are arranged to be spaced apart evenly from one another at the interval along the scanning direction in positions between adjoining corrugating plates 14 to support the recording sheet P from below.

Upper ends of the ribs 20 are at a position higher than the pressers 14*a*. In other words, the ribs 20 support the recording sheet P from below at positions higher than positions where the pressers 14*a* contact or press the recording sheet P.

The ejection rollers 16 are arranged in positions downstream of the inkjet head 12 with regard to the conveying direction. The ejection rollers 16 are located in the same positions as the ribs 16 with regard to the scanning direction. Each ejection roller 16 includes an upper roller 16*a* and a lower roller 16*b*, between which the recording sheet P may be nipped from above and below to be conveyed in the conveying direction. The ejection rollers 16 thus convey the recording sheet P in the conveying direction toward the sheet ejector unit 4. The lower rollers 16*b* may be driven to rotate by the conveyor motor 57 (see FIG. 5). The upper rollers 16*a* are spur wheels and may be rotated by the rotation of the lower rollers 16*b*. The upper rollers 16*a* may contact a printed surface of the recording sheet P, which is a surface having an image printed thereon in the ongoing printing operation. However, while the upper rollers 16*a* are spurs, of which outer circumferences are not smooth, the ink in the printed image on the recording sheet P may be restrained from being transferred to the upper rollers 16*a*. Thus, the conveyance roller 13 and the ejection rollers 16 may convey the recording sheet P.

The corrugating spur wheels 17 are arranged in positions downstream from the ejection rollers 16 with regard to the conveying direction and may contact to press the recording sheet P from above. The corrugating spur wheels 17 are substantially at the same positions as the pressers 14*a* of corrugating plates 14 with regard to the scanning direction. The corrugating spur wheels 17 are not rollers with smooth outer circumferences but spur wheels. Therefore, the ink on the recording sheet P may be restrained from being transferred to the corrugating spur wheels 17.

It may be noted that the above-mentioned quantities of the corrugating plates 14, the ribs 20, the ejection rollers 16, and the corrugating spur wheels 17 are merely examples, and the numbers may not necessarily be limited to these.

The recording sheet P may be supported by the eight (8) ribs 20 and the eight (8) lower rollers 16*b* on a lower surface from below and by the nine (9) pressers 14*a* of the corrugating plates 14 and the nine (9) corrugating spur wheels 17 on the upper surface from above to be shaped into the corrugated form, as shown in FIGS. 3 and 4, which ripples up and down along the scanning direction.

[Controller]

Next, explanation concerning the controller 50 for controlling operations and processes in the printer 1 will be provided below. The controller 50 includes a central processing unit (CPU) 51, a ROM 52, a RAM 53, an EEPROM 54, and an application specific integrated circuit (ASIC) 55.

The controller 50 controls behaviors of the carriage motor 56, the driver IC 40, the inkjet head 12, the conveyor motor 57, the reader unit 5, and the display unit 7. Further, the controller 50 may receive various types of signals, including signals corresponding to operations to the operation unit 6.

Figure 5:
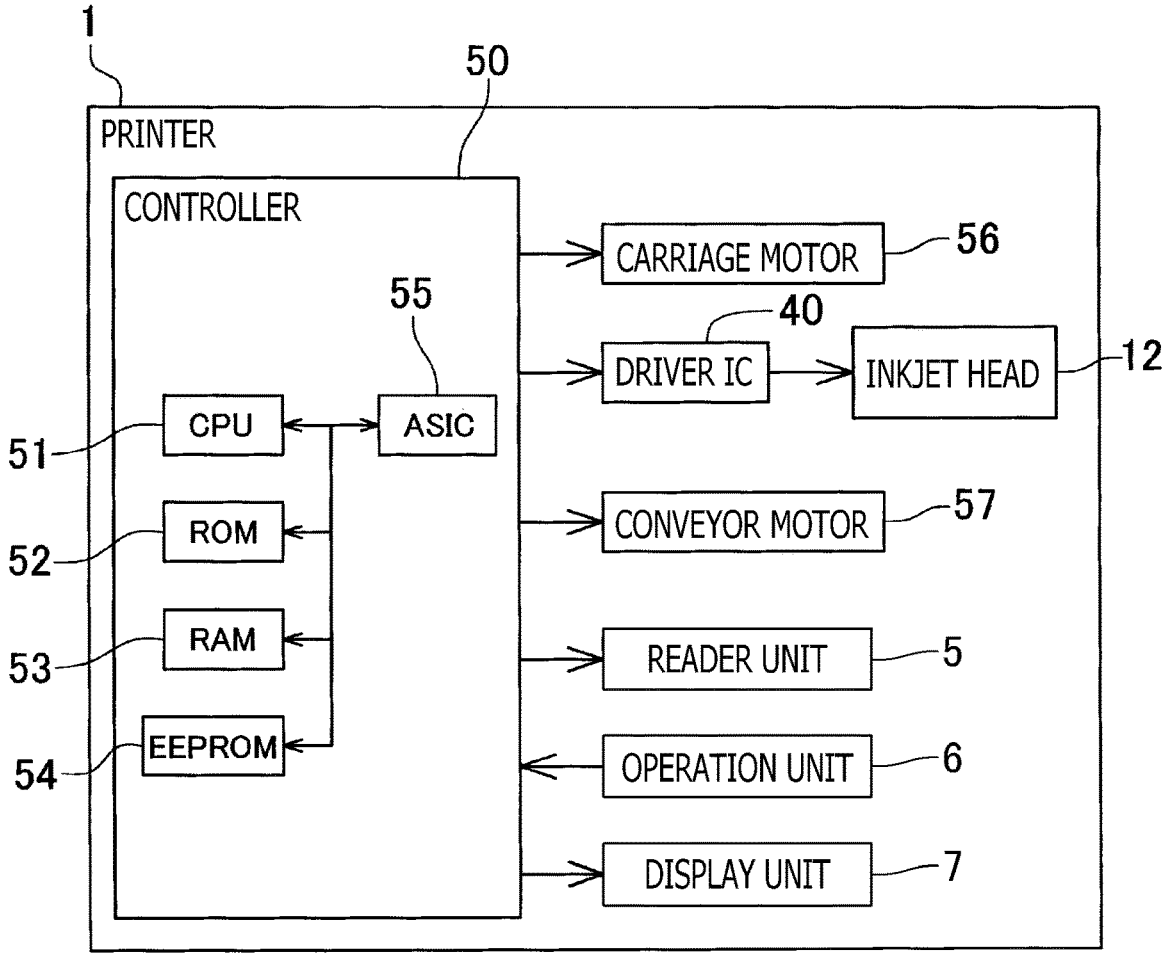
FIG. 5 is a block diagram to illustrate an electrical configuration of the printer according to the first embodiment of the present disclosure.

While FIG. 5 shows solely one (1) CPU 51 to process the signals in the controller 50, the CPU 51 may not necessarily be limited to a single CPU 51 that processes the signals alone but may include a plurality of CPUs 51 that may share the loads of the signal-processing. Further, the ASIC 55 in the controller 50 may not necessarily be limited to a single ASIC that processes the signals alone but may include multiple ASICs 55 that may share the loads of the signal-processing.

[Printing Operation]

Figure 6:
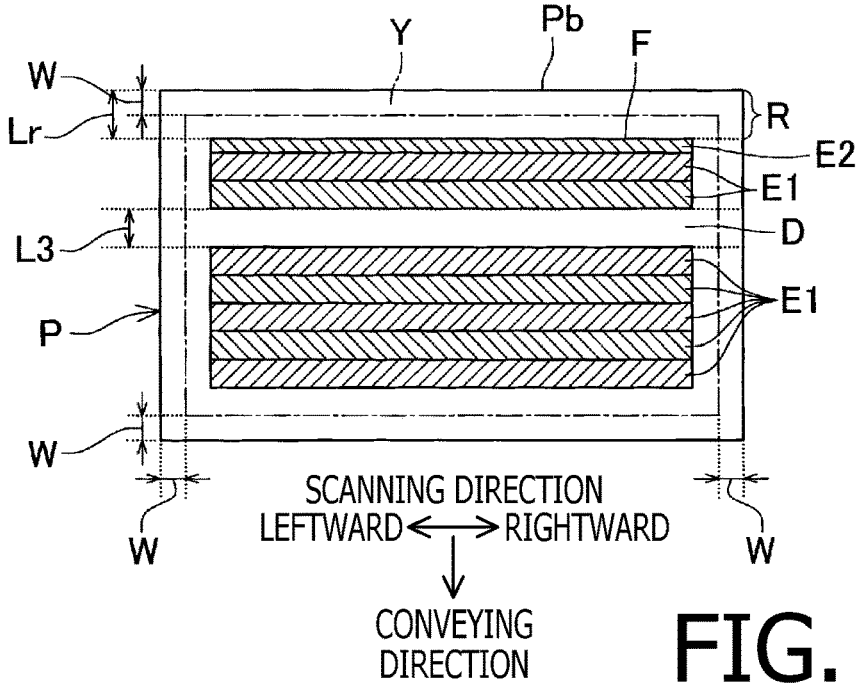
FIG. 6 illustrates an image to be printed in a margined printing mode in the printer according to the first embodiment of the present disclosure.

Next, actions in a printing operation to print an image on the recording sheet P will be described. The printing unit 2 may conduct the printing operation in a so-called margined printing mode, in which a margin Y, i.e., an outer peripheral region with respect to a dash-and-dot line as shown in FIG. 6, is reserved on each side of the recording sheet P so that printing of an image in the reserved margin Y is restricted, but an image should be printed on an inner region with respect to the dash-and-dot line. A width W of the margin, or a length from an edge of the recording sheet P to the inner region, is set at a predetermined minimum value Wm or larger. The minimum value Wm is larger than the distance K between the downstream end 14*b* of the presser 14*a* and the nozzle 10*c* along the conveying direction and may be, for example, 3 mm. A difference [Wm-K] between the minimum value Wm and the distance K may be, for example, 1 mm.

When print data is input to the printer 1, the controller 50 conducts a printing operation, in which a unit-printing process may be repeated for a plurality of times, to print an image corresponding to the print data. In each unit-printing process, a conveying action, in which the controller 50 controls the conveyor motor 57 to manipulate the conveyance roller 13 and the ejection rollers 16 to convey the recording sheet P in the conveying direction, and a scan-printing action, in which the controller 50 controls the carriage motor 56 to move the carriage 11 in the scanning direction and controls the driver IC 40 to manipulate the inkjet head 12 to eject the ink through the nozzles 10, are conducted.

While the recording sheet P is in the corrugated shape rippling up and down along the scanning direction, height of the recording sheet P, i.e., a gap between the recording sheet P and the ink ejection surface 12*a*, at each position along the scanning direction may vary, and the recording sheet P may expand or contract in the scanning direction depending on the condition of the ripples. Therefore, in the scan-printing action, ejection timing to eject the ink through the nozzles 10 at the recording sheet P may be corrected in consideration of the variation of the gap amount and the expansion/contraction amount in the recording sheet P. However, correction of the ejection timing in the scan-printing action may not necessarily be related to the present embodiment directly. Therefore, detailed explanation concerning correction of the ejection timing will be herein omitted.

In the printing operation, the controller 50 may control the printing unit 2 to print an image, containing rows of images, on the recording sheet P according to the flow of steps shown in FIG. 6.

Figure 7:
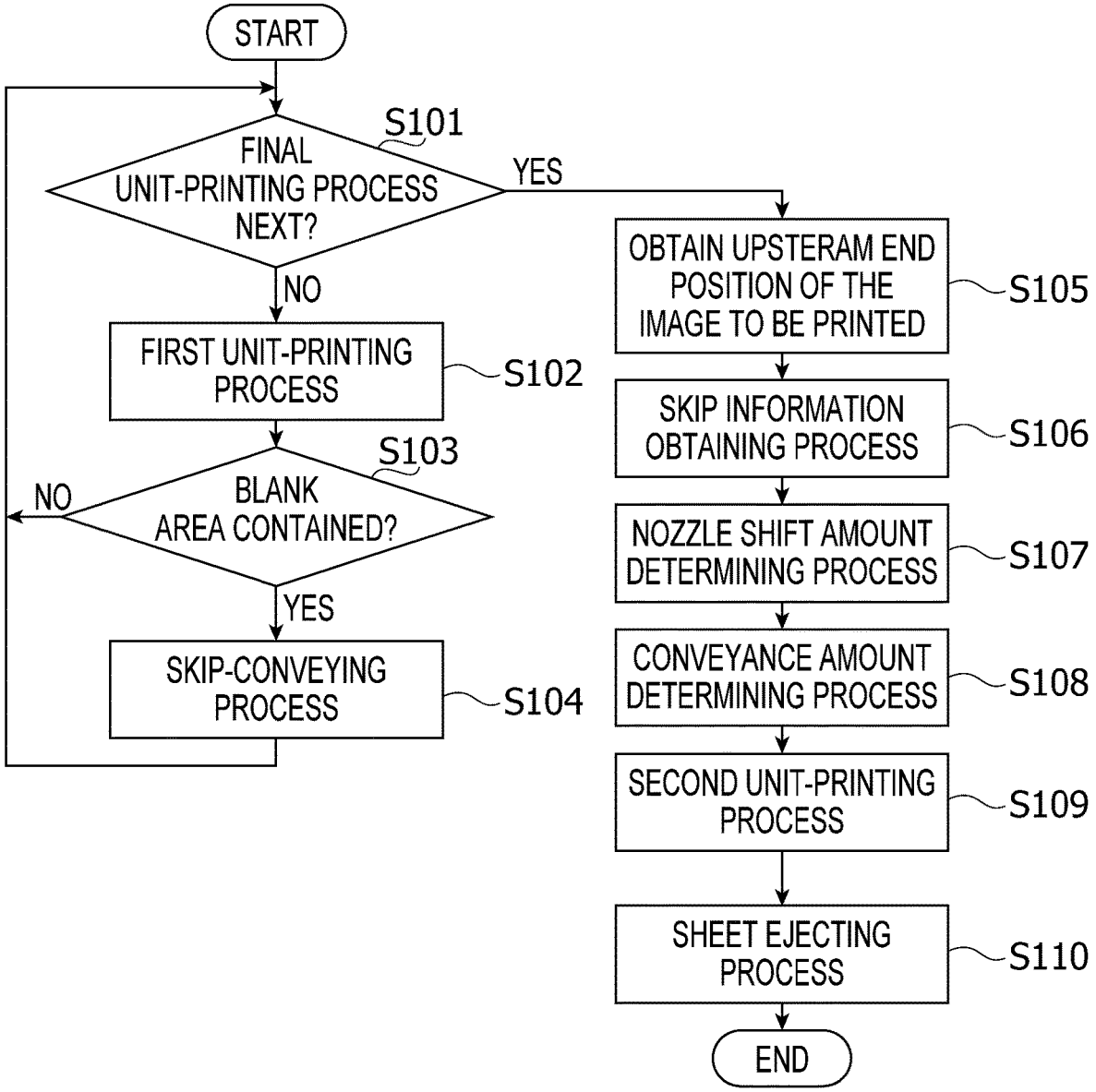
FIG. 7 is a flowchart to illustrate a flow of steps in a printing operation to be conducted by a controller in the printer according to the first embodiment of the present disclosure.

Below will be described more specifically the printing operation. As shown in FIG. 7, in S101, the controller 50 determines based on the print data whether a next upcoming unit-printing process is a final unit-printing process in the ongoing printing operation.

When the next unit-printing process is not a final unit-printing process in the ongoing printing operation (S101: NO), in S102, the controller 50 conducts a first unit-printing process. Specifically, as shown in FIG. 8A, in S201, the controller 50 conducts a first conveying action. In the first conveying action, the controller 50 controls the conveyor motor 57 to manipulate the conveyance roller 13 and the ejection rollers 16 to convey the recording sheet P in the conveying direction for a length L1, which is equal to the length of the nozzle arrays 9 along the conveying direction, as shown in FIG. 9A. When the recording sheet P is conveyed in the first conveying action, a center Pc of the recording sheet P in the scanning direction is located to align with a center 60*a* of a movable range 60 for the inkjet head 12 to move during the scan-printing action. In the present embodiment, if no skip-conveying action, which will be described later, is conducted following a latest first unit-printing process, the conveying action to convey the recording sheet P in S201 may be regarded as the first conveying action in the present disclosure; meanwhile, if a skip-conveying action is conducted following the latest first unit-printing process, the conveying action to convey the recording sheet P in S201 and a conveying action to convey the recording sheet P in the skip-conveying action, which will be described later, combined together may be regarded as the first conveying action in the present disclosure.

Following S201, in S202, the controller 50 conducts a first scan-printing action. Specifically, the controller 50 controls the carriage motor 56 to move the carriage 11 along the scanning direction. Simultaneously, the controller 50 controls the driver IC 40 to manipulate the inkjet head 12 to eject the ink through the nozzles 10 to print a row of image E1. In the first scan-printing action, as shown in FIG. 9A, nozzles 10*a* at a most downstream position with regard to the conveying direction among the entire nozzles 10 that form the nozzle arrays 9 are designated as the nozzles 10 active at a most downstream position for the first scan-printing action. With this nozzle designation, a length of the row of image E1 to be printed in the first scan-printing action along the conveying direction may be maximized to the largest for the inkjet head 12, and a number of scan-printing actions necessary to complete the printing operation may be minimized.

Returning to the flow in FIG. 7, following S102, in S103, the controller 50 inspects the print data and determines whether the image to be printed in the ongoing printing operation should contain a blank area D (see FIG. 6), in which no row of image is to be printed, having a predetermined length Lm or larger along the conveying direction, at an upstream adjacent position from the image E1 printed in the latest first scan-printing action in S202. The length Lm may be, for example, from 4 to 5% of the length L1 of the nozzle arrays 9. If no blank area D is contained (S103: NO), the flow returns to S101. On the other hand, if the image contains the blank area D (S103: YES), in S104, the controller 50 conducts a skip-conveying action and thereafter returns to S101.

In the skip-conveying action in S104, specifically as shown in FIG. 8B, in S301, the controller 50 calculates a value A, which indicates a predicted position of the recording sheet P after the recording sheet P is conveyed from the current position for a length L3 in the conveying direction. The value A to indicate the predicted position of the recording sheet P is plotted to be larger if the recording sheet P is located further downstream and to be smaller if the position is located further upstream with regard to the conveying direction. In other words, the closer the recording sheet P is to a downstream end of the sheet conveyance, the larger value the value A should take. Following S301, in S302, the controller 50 determines whether the calculated value A is larger than a predetermined threshold value Am, which is prepared and stored in advance in the EEPROM 54.

The threshold value Am may be a value, that corresponds to a position of the recording sheet P when an upstream end Pb of the recording sheet P with regard to the conveying direction is located at an upstream position spaced apart from the downstream end 14*b* of the presser 14*a* for a predetermined length L2. Therefore, when the upstream end Pb of the recording sheet P is at the upstream position spaced apart from the downstream end 14*b* of the presser 14*a* for the predetermined length L2 or larger, the value A is smaller than or equal to the threshold value Am. In this position, the recording sheet P contacts the pressers 14*a* and may be pressed downward by the pressers 14*a*. On the other hand, when the upstream end Pb of the recording sheet P is at a position downstream from the upstream position spaced apart from the downstream end 14*b* of the presser 14, the value A is greater than the threshold value Am. In this position, the recording sheet P is separated from the pressers 14*a* along the conveying direction and may not be pressed by the pressers 14*a*.

If the calculated value A is smaller than or equal to the threshold value Am (S302: NO), in S303, the controller 50 controls the conveyor motor 57 to manipulate the conveyance roller 13 and the ejection rollers 16 to convey the recording sheet P in the conveying direction for the length L3. On the other hand, if the calculated value A is larger than the threshold value Am (S302: YES), in S304, the controller 50 controls the conveyor motor 57 to manipulate the conveyance roller 13 and the ejection rollers 16 to convey the recording sheet P in the conveying direction for a length L4 (not shown), which is shorter than the length L3 of the blank area D. The length L4 is a length within a range, in which the recording sheet P may be maintained contacted or pressed by the pressers 14*a*, even after being conveyed for that length. When the recording sheet P is conveyed in S303 or S304, the center Pc of the recording sheet P in the scanning direction is located to align with the center 60*a* of the movable range 60 for the inkjet head 12.

Thus, when the blank area D exits in the print data and in the image to be printed, the skip-conveying action is conducted to convey the recording sheet P so that time required to print the complete image may be shortened. In order to convey the recording sheet P, when the calculated value A is smaller than or equal to the threshold value Am (S302: NO), the recording sheet P is conveyed for the length L3, which is the length of the blank area D. On the other hand, when the calculated value A is larger than the threshold value Am (S302: YES), the recording sheet P is conveyed for the length L4, which is shorter than the length L3 of the blank area D. Thus, the recording sheet P may be prevented from being conveyed as far as to a position, where the recording sheet P is separated from the pressers 14*a* along the conveying direction and is not pressed by the pressers 14*a*.

Following S303 or S304, in S305, the controller 50 updates a cumulative value indicating a retrospective sum of hitherto conveyed amounts for the recording sheet P in the past skip-conveying actions in the ongoing printing operation. Specifically, while a cumulative value T of conveyance amounts, for which the recording sheet P was conveyed in the past skip-conveying actions in the ongoing printing operation, is stored in the RAM 53, in S305, the conveyance amount, i.e., either L3 or L4, in the current skip-conveying action in either S303 or S304 is added to the cumulative value T in the RAM 53.

Meanwhile, in S101, when the next unit-printing process is a final unit-printing process (S101: YES), in S105, the controller 50 obtains edge position information concerning a position of an upstream edge F (see FIG. 6) of an image to be printed on the recording sheet P. When provided with the position of the upstream edge F of the image to be printed on the recording sheet P, a length Lr of a non-printing region R, in which no image is to be printed, on a rim on the upstream side of the recording sheet P with regard to the conveying direction is determined. In other words, the edge position information is related to length information concerning the length Lr of the non-printing region R. Following S105, in S106, the controller 50 conducts a skip information obtaining process, in which the controller 50 reads the RAM 53 to obtain the cumulative value T. As shown in FIG. 6, the non-printing region R may include a part of the margin Y and a part of the inner region with respect to the dash-and-dot line.

Following S106, in S107, the controller conducts a nozzle shift amount determining process to determine a nozzle shift amount B based on the edge position information and the cumulative value T. The nozzle shift amount B is increased to be larger if the edge position information concerning the position of the upstream edge F indicates a position closer to a downstream end of sheet conveyance with regard to the conveying direction. In other words, the longer the length Lr of the non-printing region R in the conveying direction is, the larger value the nozzle shift amount B takes. Further, the larger a remainder U of the cumulative value T divided by the length L1 of the nozzle arrays 9 is, the larger the nozzle shift amount B is increased to be. As shown in FIGS. 9B-9C, nozzles 10*b* at a position shifted upstream from the nozzles 10*a* for the nozzle shift amount B among the entire nozzles 10 that form the nozzle arrays 9 are designated as the nozzles 10 active at the most downstream position for a second scan-printing action in a second unit-printing process, which will be conducted later in S109.

Following S107, in S108, the controller 50 conducts a conveyance amount determining process to determine an amount to convey the recording sheet P in a second conveying action, which will be described later. In the conveyance amount determining process, a conveyance amount [L1-B], which is a difference between the length L1 of the nozzle arrays 9 and the nozzle shift amount B, is determined to be the amount to convey the recording sheet P in the second conveying action. Accordingly, in the first embodiment, the longer the length Lr of the non-printing region R is, the smaller the conveyance amount [L1-B] to convey the recording sheet P in the second conveying action is reduced to be.

In the present embodiment, the nozzle shift amount B is determined earlier in S107, and the amount to convey the recording sheet P for the second conveying action is determined later in S108 based on the nozzle shift amount B. However, the order to determine the nozzle shift amount B and the conveyance amount may alternatively be reversed. In other words, the amount to convey the recording sheet P in the second conveying action, i.e., an amount corresponding to the conveyance amount [L1-B], may be determined earlier, and the nozzle shift amount B may be determined based on the conveyance amount later.

Following S108, in S109, the controller 50 conducts a second unit-printing process. In the second unit-printing process, as shown in FIG. 8C, in S401, the controller 50 conducts a second conveying action. Specifically, the controller 50 controls the conveyor motor 57 to manipulate the conveyance roller 13 and the ejection rollers 16 to convey the recording sheet P in the conveying direction for the conveyance amount [L1-B], as shown in FIGS. 9B-9C.

When the recording sheet P is conveyed in S401, as shown in FIGS. 9B-9C, the larger the length Lr of the non-printing region R is; the larger value the nozzle shift amount B takes; the smaller value the conveyance amount [L1-B] takes; and, at a point when this second conveying action is completed, the closer to an upstream end, or beginning, of the sheet conveyance the recording sheet P is located. When the recording sheet P is conveyed in S401, the center Pc of the recording sheet P with regard to the scanning direction is located to align with the center 60*a* of the movable range 60 for the inkjet head 12. In the present embodiment, if no skip-conveying action, which will be described later, is conducted following a latest first unit-printing process, the conveying action to convey the recording sheet P in S401 may be regarded as the second conveying action in the present disclosure; meanwhile, if a skip-conveying action is conducted following the latest first unit-printing process, the conveying action to convey the recording sheet P in S401 and a conveying action to convey the recording sheet P in the skip-conveying action, which will be described later, combined together may be regarded as the second conveying action in the present disclosure.

Following S401, in S402, the controller 50 conducts a second scan-printing action. In the second scan-printing action, the controller 50 controls the carriage motor 56 to move the carriage 11 along the scanning direction. Simultaneously, the controller 50 controls the driver IC 40 to manipulate the inkjet head 12 to eject the ink through the nozzles 10 to print a row of image E2 (see FIG. 6), which is a most upstream part of the image to be printed with regard to the conveying direction. In the second scan-printing action, as mentioned above, the nozzles 10*b* at a position shifted upstream from the nozzles 10*a* for the nozzle shift amount B among the entire nozzles 10 that form the nozzle arrays 9 are designated as the nozzles 10 active at the most downstream position for the second scan-printing action. In other words, the nozzles 10 that fall in the range of the nozzle shift amount B are not used for the second scan-printing action.

Following the second unit-printing process in S109, in S110, the controller 50 conducts a sheet ejecting process and ends the flow thereat. In the sheet ejecting process in S110, the controller 57 controls the conveyor motor 57 to manipulate the ejection roller 16 to convey the recording sheet P at the ejection unit 4 to eject the recording sheet P.

In this regard, attention may be drawn to a hypothetical flow of steps, in which the first unit-printing process is conducted even when the next unit-printing process is the final unit-printing process in the ongoing printing operation (S101: YES), unlike the present embodiment. According to this hypothetical flow, as shown in FIG. 9D, as a result of the conveyance in the final first conveying action, the recording sheet P may be located at a position, in which the recording sheet P is separated from the pressers 14*a* in the conveying direction and not contacted to be pressed by the pressers 14*a*. In this position, the upstream end Pb of the recording sheet P with regard to the conveying direction released from the pressers 14*a* may hover upward and collide with the ink ejection surface 12*a* in the following first scan-printing action. If the recording sheet P collides with the ink ejection surface 12*a*, the ink on the ink ejection surface 12*a* may be undesirably transferred to the recording sheet P.

In consideration of such an undesirable event, according to the present embodiment, when the next unit-printing process is a final unit-printing process in the ongoing printing operation (S101: YES), the controller 50 conducts the second unit-printing process for the final unit-printing process. In the second conveying action in the second unit-printing process, the recording sheet P is conveyed for the amount [L1-B], which is smaller than the conveyance amount L1 in the first conveying action for the nozzle shift amount B. Therefore, as shown in FIGS. 9B-9C, the recording sheet P conveyed in the second conveying action may be maintained contacted to be pressed by the pressers 14*a* at the upstream end Pb with regard to the conveying direction. Thus, the recording sheet P may be prevented from colliding with the ink ejection surface 12*a* in the succeeding second scan-printing action.

Further, in the first embodiment, the closer to the upstream end of the sheet conveyance the upstream edge F of the image to be printed is located, in other words, the longer the length Lr of the non-printing region R is; the smaller value the conveyance amount [L-B] for the second conveying action takes, and the nozzles 10 closer to the upstream end among the entire nozzles 10 are designated to serve as the nozzles 10 active at the most downstream position for the second scan-printing action. Therefore, as shown in FIGS. 9B-9C, the closer to the upstream end of the sheet conveyance the upstream edge F of the image to be printed is located, in other words, the longer the length Lr of the non-printing region R is, at the inner part, or at the part farther from the upstream end Pb, with regard to the conveying direction, the recording sheet P is pressed by the pressers 14*a*. Accordingly, during the final scan-printing action, the recording sheet P may be pressed by the pressers 14*a* at the part as inner as possible with regard to the conveying direction, to be stably pressed by the pressers 14*a* until as late as possible.

Meanwhile, relative position between the recording sheet P and the pressers 14*a* immediately after completion of the conveying action in the final unit-printing process, i.e., immediately before the scan-printing action in the final unit-printing process, may vary due to various factors, including variation in sizes and positions of the corrugating plates 14 (the pressers 14*a*); conveyance amounts for the recording sheet P having been conveyed in the first conveying action(s), the second conveying action, and the skip-conveying action(s); and lengths of the recording sheet P in the conveying direction. In this regard, in the first embodiment described above, the recording sheet P may be pressed by the pressers 14*a* at the part as inner as possible with regard to the conveying direction during the final scan-printing action. Therefore, even in the varied relative position with the pressers 14*a*, the recording sheet P may be securely prevented from being conveyed to the position, where the recording sheet P is not pressed by the pressers 14*a*, as a result of the final conveying action immediately before the final scan-printing action.

Further, in the first embodiment, in the skip-conveying action, the larger the remainder U of the cumulative value T divided by the length L1 of the nozzle arrays 9 is, at the point immediately before the final unit-printing process, the closer to the downstream end of the sheet conveyance the recording sheet P is located. In this regard, the nozzle shift amount B, or the conveyance amount [L1-B], is derived from the position of the upstream edge F of the image to be printed, i.e., the length Lr of the non-printing region R, and from the cumulative value T. In other word, the nozzle shift amount B, or the conveyance amount [L1-B], and the nozzles 10*b* to serve at the most downstream position with regard to the conveying direction for the second scan-printing action among the entire nozzles 10 may be designated preferably even after the skip-conveying action.

In the first embodiment, during the margined printing mode, the minimum value Wm for the width W of the margin Y is set to be larger than the distance K between the downstream end 14*b* of the pressers 14*a* and the nozzles 10*c* at the most upstream position in the inkjet head 12 with regard to the conveying direction. Meanwhile, in order to print the image in the inner region with respect to the margin Y on the recording sheet P, the length Lr of the non-printing region R is set to be greater than or equal to the width W of the margin Y. Accordingly, the length Lr of the non-printing region R is larger than the distance K. Thus, the nozzle shift amount B, or the conveyance amount [L1-B], for the final scan-printing action may be set to the amount, by which the recording sheet P may be maintained pressed by the pressers 14*a* by the upstream end Pb thereof after being conveyed in the conveying direction.

The difference [Wm-K] between the minimum value Wm and the distance K may be 1 mm. Therefore, the recording sheet P may be pressed by the pressers 14*a* at a position downstream apart from the upstream end Pb for the length 1 mm or larger with regard to the conveying direction during the final scan-printing action. Thus, even when the relative position between the recording sheet P and the pressers 14*a* varies, the recording sheet P may be stably pressed by the pressers 14*a* at the upstream end Pb thereof.

Second Embodiment

Below will be described a second embodiment of the present disclosure.

A printer 101 in the second embodiment includes, as shown in FIGS. 10 and 11, a carriage 102, an inkjet head 103, a platen 104, and conveyance rollers 105, 106. The carriage 102 is supported by two (2) guide rails 111, which extend in the scanning direction. The carriage 102 is connected with a carriage motor 156 (see FIG. 156) through a belt (not shown) to be movable on the guide rails 111 to reciprocate in the scanning direction.

The inkjet head 103 is mounted on the carriage 102 to be movable along with the carriage 102. The inkjet head 103 is configured to eject ink from a plurality of nozzles 110 formed in an ink ejection surface 103*a*, which is a lower surface of the inkjet head 103. The nozzles 110 are formed in lines that extend orthogonally to the scanning direction within the length L1 to form nozzle arrays 109. In the inkjet head 103, a plurality of, e.g., four, nozzle arrays 109 are formed so that inks in four colors, e.g., black, yellow, cyan, and magenta, may be ejected separately from each nozzle array 109. The inkjet head 103 may be driven by a driver IC 140 (see FIG. 12).

The platen 104 is arranged in a lower position with respect to the inkjet head 103 to vertically face the ink ejection surface 103*a*. The platen 15 supports the recording sheet P, at which the ink is ejected through the nozzles 110 of the inkjet head 103, from below.

The conveyance roller 105 includes a pair of rollers 105*a*, which are arranged in positions upstream of the platen 104 with regard to the conveying direction. The conveyance roller 105 may be driven to rotate by a conveyor motor 157 (see FIG. 12) and nip the recording sheet P to convey in the conveying direction. The conveyance roller 106 includes a pair of rollers 106*a*, which are arranged in positions downstream of the platen 104 with regard to the conveying direction. The conveyance roller 106 may be driven to rotate by the conveyor motor 157 and nip the recording sheet P to convey in the conveying direction. In the second embodiment, unlike the first embodiment, the recording sheet P is not shaped into the corrugated shape but is conveyed flat along the scanning direction.

Next, explanation concerning a controller 150 for controlling operations and processes in the printer 101 will be provided below. The controller 150 includes a CPU 151, a ROM 152, a RAM 153, an EEPROM 154, and an ASIC 155.

The controller 150 controls behaviors of the carriage motor 156, the driver IC 140, and the conveyor motor 157.

Below will be described actions in a printing operation to print an image on the recording sheet P. In the second embodiment, analogously to the first embodiment, as shown in FIG. 6, the printing unit 2 may conduct the printing operation in the margined printing mode, in which the margin Y is reserved on the rim on each side of the recording sheet P so that no image may be printed in the margin Y, but an image should be printed on the inner region. Meanwhile, in the second embodiment, the minimum value Wm for the width W of the margin Y is larger than a distance J between nozzles 110*c*, which are at a most upstream position with regard to the conveying direction among the nozzles 110 forming the nozzle arrays 109, and the conveyance roller 105. A difference [Wm-J] between the minimum value Wm and the distance J may be, for example, 1 mm.

When the print data is input to the printer 101, the controller 150 conducts the printing operation, analogously to the first embodiment, according to the flows illustrated in FIGS. 7 and 8A-8C, except details in the first conveying action in S201, the first scan-printing action in S202, the second conveying actions in S401, the second scan-printing action in S402, the comparison in S302, and the skip-conveying action in S304.

Specifically, in the first and second conveying actions in S201 and S401, respectively, the controller 150 controls the conveyor motor 157 to manipulate the conveyance rollers 105, 106 to convey the recording sheet P in the conveying direction.

Further, in the first and second scan-printing actions in S202, S402, respectively, the controller 150 controls the carriage motor 156 to move the carriage 102 in the scanning direction and simultaneously controls the driver IC 140 to manipulate the inkjet head 103 to eject the ink through the nozzles 110 at the recording sheet P. In the first scan-printing action in the second embodiment, nozzles 110*a* at a most downstream position with regard to the conveying direction among the entire nozzles 110 that form the nozzle arrays 109 are designated as the nozzles 110 active at the most downstream position for the first scan-printing action. In the second scan-printing action in the second embodiment, nozzles 110 at a position shifted upstream from the nozzles 110*a* for the nozzle shift amount B among the entire nozzles 110 that form the nozzle arrays 109 are designated as the nozzles 110 active at the most downstream position for the second scan-printing action to print the most downstream part of the image printed in the second scan-printing action.

Further, in the second embodiment, the threshold value Am to be compared with the calculated value A is set to be a value, which corresponds to a position of the recording sheet P when the upstream end Pb of the recording sheet P is at the position of the conveyance roller 105. Moreover, in S304, the length L4 to convey the recording sheet P in the skip-conveying action is set to be an amount, by which the recording sheet P is conveyed to a position where the recording sheet P is not pressed by the conveyance roller 105 as a result of being conveyed for that amount.

In this regard, attention may be drawn to a hypothetical flow of steps, in which the first unit-printing process is conducted even when the next unit-printing process is the final unit-printing process in the ongoing printing operation (S101: YES), unlike the present embodiment. According to this hypothetical flow, as a result of conveyance in the final first conveying action, the recording sheet P may be located at a position, in which the recording sheet P is separated from conveyance roller 105 and not pressed by the conveyance roller 105. In this position, the upstream end Pb of the recording sheet P with regard to the conveying direction released from the conveyance roller 105 may hover upward and collide with the ink ejection surface 103*a* in the succeeding first scan-printing action. If the recording sheet P collides with the ink ejection surface 103*a*, the ink on the ink ejection surface 103*a* may be undesirably transferred to the recording sheet P.

In consideration of such an undesirable event, according to the present embodiment, when the next unit-printing process is a final unit-printing process in the ongoing printing operation, the controller 150 conducts the second unit-printing process for the final unit-printing process. As a result of the second conveying action in the second unit-printing process, the recording sheet P may be maintained pressed by the conveyance roller 105 at the upstream end Pb with regard to the conveying direction. Thus, the recording sheet P may be prevented from colliding with the ink ejection surface 103*a* in the succeeding second scan-printing action to print the row of image E2.

Further, in the second embodiment, analogously to the first embodiment, the longer the length Lr of the non-printing region R is, the smaller value the conveyance amount [L1-B] for the second conveying action takes, and the nozzles 110 closer to the upstream end among the entire nozzles 110 are designated to serve as the nozzles 110 active at the most downstream position for the second scan-printing action. Therefore, the longer the length Lr of the non-printing region R is, that is, the closer to the downstream end of the sheet conveyance the upstream end of the row of image to be printed is located, during the final scan-printing action, the recording sheet P may be pressed by the conveyance roller 105 at the part as inner as possible with regard to the conveying direction, to be stably held by the conveyance roller 105 until as late as possible.

Meanwhile, relative position between the recording sheet P and the conveyance roller 105 immediately after completion of the conveying action in the final unit-printing process, i.e., immediately before the scan-printing action in the final unit-printing process, may vary due to various factors, including variation in sizes and positions of the conveyance rollers 105; conveyance amounts to convey the recording sheet P in the first conveying action(s), the second conveying action, and the skip-conveying action(s); and lengths of the recording sheet P in the conveying direction. In this regard, in the second embodiment described above, the recording sheet P may be pressed by the conveyance roller 105 at the part as inner as possible with regard to the conveying direction during the final scan-printing action. Therefore, even in the varied relative position with the conveyance roller 105, the recording sheet P may be securely prevented from being conveyed to the position, where the recording sheet P is not pressed by the conveyance roller 105 as a result of the final conveying action.

In the second embodiment, analogously to the first embodiment, in the skip-conveying action, the skip-conveying action may serve to shorten the time required to print the complete image. Meanwhile, the recording sheet P may be prevented from being conveyed as far as to a position, where the recording sheet P is separated from the conveyance roller 105 along the conveying direction and is not pressed by the conveyance roller 105.

In the second embodiment, analogously to the first embodiment, the nozzle shift amount B, or the conveyance amount [L1-B], may be derived from the length Lr of the non-printing region R in the conveying direction and the cumulative value T, and thereby, the nozzles 110 to serve at the most downstream position with regard to the conveying direction for the second scan-printing action among the entire nozzles 110 may be designated preferably even after the skip-conveying action.

In the second embodiment, analogously to the first embodiment, during the margined printing mode, the minimum value Wm for the width W of the margin Y is set to be larger than the distance J, between the nozzles 110*c*, which are at a most upstream position with regard to the conveying direction among the nozzles 110 forming the nozzle arrays 109, and the conveyance roller 105; therefore, the length Lr of the non-printing region R is longer than the distance J. Thus, the nozzle shift amount B, or the conveyance amount [L1-B], for the final scan-printing action may be set to the amount, by which the recording sheet P may be maintained pressed by the conveyance roller 105 by the upstream end Pb thereof after being conveyed for that amount in the conveying direction.

In the second embodiment, analogously to the first embodiment, the difference [Wm-J] between the minimum value Wm and the distance J may be 1 mm. Therefore, the recording sheet P may be pressed by the conveyance roller 105 at a position downstream apart from the upstream end Pb for the length 1 mm or larger with regard to the conveying direction during the final scan-printing action. Thus, even when the relative position between the recording sheet P and the conveyance roller 105 varies, the recording sheet P may be stably pressed by the conveyance roller 105 at the upstream end Pb thereof.

More Examples

Although examples of carrying out the invention have been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described varied examples of the present embodiment.

For example, the information concerning the length Lr of the non-printing region R may not necessarily be derived from the edge position information concerning the position of the upstream edge F of the image to be printed with regard to the conveying direction but may be, for example, obtained from the print data in S105.

For another example, the recording sheet P may not necessarily be conveyed in the skip-conveying action in S303 or S304 for the length L3 or L4 separately from the first or second conveying action in S201, S401 in the first or second unit-printing process. For example, an amount to convey the recording sheet P, which is either L3 or L4, derived from the comparison between the value A calculated in S301 and the threshold value Am, may be stored in the RAM 53. Thereafter, prior to a scan-printing action in a next unit-printing process, the recording sheet P may be conveyed for an amount, which combines the conveyance amount for the conveying action in S201 or S204, i.e., the conveyance amount either L1 or [L1-B], with the conveyance amount L3 or L4 stored in the RAM 53.

For another example, in the skip-conveying action in the first embodiment, the threshold value Am, which is compared with the value A calculated in S301 in order to determine whether the recording sheet P is predicted to be conveyed to the position where the recording sheet P is not pressed by the pressers 14*a*, may not necessarily be the value that corresponds to the position of the recording sheet P when the upstream end Pb of the recording sheet P with regard to the conveying direction is located at the upstream position spaced apart from the downstream ends 14*b* of the pressers 14*a* for the predetermined length L2. For example, the threshold value Am may be a value that corresponds to a position of the recording sheet P when the upstream end Pb of the recording sheet P with regard to the conveying direction is located at the same position as the downstream ends 14*b* of the pressers 14*a*. In this setting, the controller 50 may determine that the recording sheet P is at a position where the recording sheet P is not pressed by the pressers 14*a* when the upstream end Pb of the recording sheet P is at a position downstream with regard to the conveying direction from the downstream ends 14*b* of the pressers 14*a*.

For another example, in the skip-conveying action in the first and second embodiments, the determination of the conveyance amount to convey the recording sheet P in the skip-conveying action between L3 and L4 may not necessarily be made based on the comparison of the value A calculated in S301 with the threshold value Am, or the recording sheet P may not necessarily be conveyed for the amount of either L3 or L4. For example, the recording sheet P may be conveyed for an amount, which corresponds to the length L3 of the blank area D but is shorter than the length L3, e.g., for a half amount of the length L3, so that the recording sheet P may be prevented from being conveyed as far as to the position where the recording sheet P is not contacted by the pressers 14*a* or the conveyance roller 105. In this setting, the time required to print the complete image may still be shortened compared to a setting, in which no skip-conveying action is conducted regardless of the presence or absence of the blank area D in the print data.

For another example, the skip-conveying action in S104 may not necessarily be conducted, regardless of the presence or absence of the blank area D in the print data, but may be omitted even when the blank area D is contained in the print data.

For another example, the width W of the margin Y in the margined printing mode may not necessarily be constant throughout the rims on all sides of the recording sheet P. The width W of the margin Y on the sides of the recording sheet P, which may be on the upstream end and the downstream end of the recording sheet P with regard to the conveying direction and on the leftward end and the rightward end with regard to the scanning direction, may be set independently, as long as the minimum value Wm for the width W of the margin Y on the upstream end of the recording sheet P with regard to the conveying direction is larger than the distance K or J.

For another example, the margin Y in the margined printing mode may not necessarily be reserved in the rims on all sides of the recording sheet P, but the margin Y may be reserved in a rim at least on the upstream end of the recording sheet P with regard to the conveying direction.

For another example, the difference [Wm-K] between minimum value Wm and the distance K, which is between the downstream end 14*b* of the pressers 14*a* and the nozzles 10*c* in the most upstream position along the conveying direction, may not necessarily be 1 mm but may be larger than 1 mm. When the difference [Wm-K] is set to be larger than 1 mm, the recording sheet P may be pressed by the pressers 14*a* more stably at a position inward with regard to the conveying direction than the position to be pressed by the pressers 14*a* in the first embodiment.

For another example, the difference [Wm-K] between minimum value Wm and the distance K may be smaller than 1 mm. When the difference [Wm-K] is set to be smaller than 1 mm, the recording sheet P may be pressed by the pressers 14*a* at an outward position closer to the upstream end Pb of the recording sheet P with regard to the conveying direction in the final scan-printing action compared to the position to be pressed by the pressers 14*a* in the first embodiment. Still, the recording sheet P may be maintained pressed by the pressers 14*a* during the second scan-printing action as long as an amount of variation of the relative position between the recording sheet P and the pressers 14*a* immediately after completion of the conveying action in the final unit-printing process is substantially small.

For another example, the minimum value Wm may not necessarily be larger than the distance K but may be smaller or equal to the distance K. Even in this setting, as long as the width W of the margin Y is larger than the distance K, the recording sheet P may be maintained pressed by the pressers 14*a* during the final scan-printing action, analogously to the first embodiment. In this regard, in the first embodiment, the nozzle shift amount B is takes a larger value, or the conveyance amount [L1-B] for the second conveying action takes a smaller value, as the length Lr of the non-printing region R takes a longer value. Therefore, even with the width W of the margin Y reduced to be shorter than the distance K, as long as the length Lr of the non-printing region R has a substantial length, the recording sheet P may be maintained pressed by the pressers 14*a* during the final scan-printing action.

Meanwhile, the difference [Wm-J] between the minimum value Wm and the distance J, which is between the nozzles 110*c* at the most upstream position with regard to the conveying direction among the nozzles 110 forming the nozzle arrays 109 and the conveyance roller 105, in the margined printing mode in the second embodiment may be larger than 1 mm or smaller than 1 mm. For another example, the minimum value Wm may be smaller than or equal to the distance J.

For another example, with regard to the first embodiment, the recording sheet P may not necessarily be shaped into the corrugated form that ripples up and down along the scanning direction but may be conveyed plainly flat along the scanning direction. For example, as mentioned in the second embodiment, a presser member to restrict the recording sheet P from hovering may be arranged in a position upstream from the nozzles at the most upstream position with regard to the conveying direction in the printer that may convey the recording sheet P in the flat form.

For another example, the second unit-printing process in the first and second embodiments may not necessarily be conducted as the final unit-printing process alone but may be conducted as a non-final unit-printing process. In this setting, with the nozzle shift amount B, or the conveyance amount [L1-B], the nozzles to serve at the most downstream position with regard to the conveying direction may be designated analogously to the first and second embodiments so that the recording sheet P may be pressed by the pressers 14*a* or the conveyance roller 105 at the part as inner as possible with regard to the conveying direction during the final scan-printing action.

For another example, the second unit-printing process may not necessarily be conducted once among the plurality of unit-printing processes that may be repeated within a single printing operation to print an image on the recording sheet P but may be conducted for twice or more in the single printing operation. If the second unit-printing process is conducted for twice or more, e.g., for N times (N≥2), in a single printing operation, a nozzle shift amount for each of the second unit-printing processes may be set to be [B/N], or a sum of the nozzle shift amounts within the second scan-printing actions for the N times may be set to be equal to the nozzle shift amount B mentioned above.

For another example, in the first and second embodiment, respectively, the nozzles 10*a*, 110*a* at the most downstream position with regard to the conveying direction among the entire nozzles 10, 110 that form the nozzle arrays 9, 109 may not necessarily be designated as the nozzles 10, 110 active at the most downstream position for the first scan-printing action. Nozzles 10, 110 that are in a position upstream from the nozzles 10*a*, 110*a* and downstream from the nozzles 10*c*, 110*c* among the nozzles 10, 110 that form the nozzle arrays 9, 109 may be designated as the nozzles 10, 110 active at the most downstream position for the first scan-printing action. In other words, any of the nozzles 10, 110 except the nozzles 10*c*, 110*c* at the most upstream position may be designated as the nozzles 10, 110 active at the most downstream position for the first scan-printing action. In this regard, the nozzles 10, 110 that are in a position upstream apart from the nozzles 10, 110 active at the most downstream position for the first scan-printing action for the nozzle shift amount B in the conveying direction may be designated to be the nozzles 10, 110 active at the most downstream position for the second scan-printing action.

For another example, the embodiments described above may not necessarily be applied to an image printing operation, in which a row of image is printed in a single scan-printing action. The embodiments may be applied to so-called interlace printing, in which an amount to convey the recording sheet P in a single conveying action may be reduced to be, for example, a half of an amount for the row, and the scan-printing action may be repeated on the same row to form the row of image.

For another example, the plurality of unit-printing processes may not necessarily consist of at least one first unit-printing process and at least one second unit-printing process. For example, with regard to the first embodiment, each one of the unit-printing processes may be the first unit-printing process. In this setting, the minimum value Wm for the width W of the margin Y in the margined printing mode should be larger than the distance K, which is between the downstream end 14*b* of the pressers 14*a* and the nozzles 10*c* at the most upstream position with regard to the conveying direction. Thereby, the recording sheet P may be maintained pressed by the pressers 14*a* at the time when the conveying action in the final unit-printing process is completed. Thus, the recording sheet P may be prevented from hovering to collide with the ink ejection surface 12*a* during the succeeding scan-printing action.

For another example, the embodiments described above may not necessarily be applied to the inkjet printer being a serial printer, which is configured to eject the ink from the inkjet head 12 while the inkjet head 12 on the carriage 11 moves in the scanning direction, but may be applied to an line printer having a linear inkjet head, which extends linearly throughout an entire widthwise range in a widthwise direction intersecting with the conveying direction.

For another example, the embodiments described above may not necessarily be applied to an inkjet printer, in which the ink is ejected through the nozzles to print an image on the recording sheet P, but may be analogously applied to a liquid ejection device, for example, that may eject liquid to print a wiring pattern on a circuit board.

What is claimed is:

1. A printing apparatus, comprising:

a conveyor configured to convey a recording medium in a conveying direction;

a liquid ejection head comprising a plurality of nozzles, the plurality of nozzles being arranged along the conveying direction to form a nozzle array;

a contact part configured to contact a surface of the recording medium that faces the liquid ejection head at a position upstream with regard to the conveying direction from a nozzle located at a most upstream position among the plurality of nozzles that form the nozzle array; and a controller configured to control the conveyor and the liquid ejection head, wherein the controller controls the conveyor and the liquid ejection head to print an image on the recording medium in a margined print mode, in which a margin is reserved in a part of a rim of an upstream side of the recording medium with regard to the conveying direction, wherein the controller is configured to execute a plurality of printing processes in the margined print mode, each one of the plurality of printing processes comprising a conveying action, in which the controller controls the conveyor to convey the recording medium in the conveying direction, and an ejecting action, in which after the conveying action the controller controls the liquid ejection head to eject liquid from the plurality of nozzles toward the recording medium to print the image on the recording medium, wherein the margin has a length along the conveying direction being equal to or larger than a predetermined minimum margin length, the length of the margin being a length between an upstream end of the recording medium with regard to the conveying direction and an upstream edge of the image to be printed on the recording medium in a final one of the plurality of printing processes with regard to the conveying direction, wherein the contact part is arranged at a position spaced apart from the nozzle at the most upstream position with regard to the conveying direction among the plurality of nozzles that form the nozzle array for a distance shorter than the minimum margin length, and wherein the length of the margin is variable with each change in a position of the upstream edge of the image to be printed on the recording medium in the final one of the plurality of printing processes with regard to the conveying direction, and wherein the minimum margin length is the length of the margin when the position of the upstream edge of the image to be printed on the recording medium in the final one of the plurality of printing processes with regard to the conveying direction is closest to the upstream end of the recording medium with regard to the conveying direction.

2. The printing apparatus according to claim 1, wherein the contact part includes a corrugating plate configured to form a corrugated shape in the recording medium, the corrugated shape having a mountain portion and a valley portion aligning along an intersecting direction that intersects orthogonally with the conveying direction.

3. The printing apparatus according to claim 1, wherein a difference between the distance and the minimum margin length is at least 1 mm.

4. The printing apparatus according to claim 1, wherein the conveying action comprises:

a first conveying action, in which a first nozzle among the plurality of nozzles that form the nozzle array is designated to be a nozzle active at a most downstream position with regard to the conveying direction for the ejecting action, the first nozzle being located at a position downstream from the nozzle at the most upstream position with regard to the conveying direction, in the first conveying action the controller controlling the conveyor to convey the recording medium for a first conveyance amount based on print data; and a second conveying action, in which a second nozzle among the plurality of nozzles that form the nozzle array is designated to be a nozzle active to print a most downstream part of the image that is to be printed in the ejecting action, the second nozzle being located at a position upstream from the first nozzle with regard to the conveying direction, in the second conveying action the controller controlling the conveyor to convey the recording medium for a second conveyance amount being smaller than the first conveyance amount for a nozzle shift amount, the nozzle shift amount being equal to a length between the first nozzle and the second nozzle along the conveying direction, wherein the plurality of printing processes comprise:

at least one occurrence of a first printing process, the first printing process taking the first conveying action as the conveying action; and at least one occurrence of a second printing process, the second printing process taking the second conveying action as the conveying action, wherein the controller further executes a length information obtaining process, in which length information related to a length of a non-printing region in the recording medium is obtained, the non-printing region being a region in which no image is printed and being reserved at the rim of the upstream side of the recording medium with regard to the conveying direction, wherein, in the second printing process, the controller designates the second nozzle, within a contact range in which the recording medium is maintained contacted by the contact part at a point where the conveying action in the final one of the plurality of printing processes is completed, such that the longer the length of the non-printing region indicated in the obtained length information is, the closer nozzle closer to an upstream end of conveyance among the plurality of nozzles that form the nozzle array is designated to be the second nozzle, wherein, the controller executes a blank determining process for each one of the plurality of printing processes except for the final one of the plurality of printing processes, in the blank determining process the controller determining based on the print data whether a blank area, in which no image is to be printed, is contained in an area at an upstream adjacent position from the image printed the ejecting action in a preceding one of the plurality of printing processes, the blank area having a length along the conveying direction equal to or larger than a predetermined minimum blank length, wherein, if the controller determines that the blank area is contained in the blank determining process, in the conveying action in a next one of the plurality of printing processes following the preceding one of the plurality of printing processes, the controller controls the conveyor to convey the recording medium for a third conveyance amount, the third conveyance amount corresponding to the length of the blank area along the conveying direction and being larger than a no-blank conveyance amount, for which the recording medium is conveyed if the blank area is not contained, and wherein the second nozzle is designated based on the length of the non-printing region indicated in the length information and the third conveyance amount.

5. The printing apparatus according to claim 4, wherein, the controller executes a conveyance predicting process, in which the controller determines whether the recording medium is predicted to be conveyed to a position where the recording medium is not contacted by the contact part as a result of conveyance for the third conveyance amount in a next one of the plurality of printing processes;

wherein, if the controller determines in the conveyance predicting process that the recording medium is predicted to be conveyed to a position where the recording medium is maintained contacted by the contact part as a result of conveyance in the next one of the plurality of printing processes, in the conveying action in the next one of the plurality of printing processes, the controller controls the conveyor to convey the recording medium for the third conveyance amount;

wherein, if the controller determines in the conveyance predicting process that the recording medium is predicted to be conveyed to the position where the recording medium is not contacted by the contact part as the result of conveyance for the third conveyance amount, in the conveyance action in the next one of the plurality of printing processes, the controller controls the conveyor to convey the recording medium within the contact range in which the recording medium is maintained contacted by the contact part for a fourth conveyance amount being smaller than the third conveyance amount; and wherein the second nozzle is designated based on the length of the non-printing region indicated in the length information, the third conveyance amount, and the fourth conveyance amount.

6. The printing apparatus according to claim 4, wherein, in the length information obtaining process, the controller obtains edge position information related to a position of the upstream edge of the image to be printed in the plurality of printing processes in the recording medium with regard to the conveying direction from the print data as the length information;

wherein, in the second printing process, the controller designates the second nozzle such that the closer to a downstream end of conveyance the position of the upstream edge of the image to be printed in the plurality of printing processes indicated in the edge position information is, the closer nozzle closer to the upstream end of conveyance among the plurality of nozzles that form the nozzle array is designated to be the second nozzle.

7. The printing apparatus according to claim 1, wherein the contact part includes a roller being one of paired rollers configured to nip the recording medium.

8. The printing apparatus according to claim 1, wherein a downstream end of the contact part is located at a position downstream from an upstream end of the liquid ejection head with regard to the conveying direction.

* * * * *